US008529423B2

(12) United States Patent
Imazu et al.

(10) Patent No.: US 8,529,423 B2
(45) Date of Patent: Sep. 10, 2013

(54) SHEET FOLDING AND IMAGE FORMATION APPARATUS

(75) Inventors: Hiroki Imazu, Kofu (JP); Shinichi Ito, Kofu (JP); Toshiaki Kagami, Minamikoma-gun (JP); Koji Kanda, Kofu (JP); Mizuho Shirakura, Fuefuki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 330 days.

(21) Appl. No.: 13/067,348

(22) Filed: May 26, 2011

(65) Prior Publication Data

US 2011/0294639 A1 Dec. 1, 2011

(30) Foreign Application Priority Data

May 28, 2010 (JP) ..... 2010-123210
Oct. 5, 2010 (JP) ..... 2010-225836

(51) Int. Cl.
*B31B 1/56* (2006.01)

(52) U.S. Cl.
USPC ..... 493/434; 493/442; 493/321; 270/32; 270/39.01

(58) Field of Classification Search
USPC ..... 493/442, 434, 421, 429, 435, 436, 493/444, 321, 385; 358/1.13; 270/32, 37, 270/41, 39.01, 39.06, 39.07, 39.08, 20.1
See application file for complete search history.

(56) References Cited

U.S. PATENT DOCUMENTS 6,599,226 B2 * 7/2003 Asai et al. ..... 493/321
6,719,680 B2 * 4/2004 Hosoya et al. ..... 493/324
7,077,798 B2 * 7/2006 Kawatsu et al. ..... 493/421
7,470,227 B2 * 12/2008 Sekine et al. ..... 493/434
2002/0045524 A1 * 4/2002 Asai et al. ..... 493/188
2005/0020425 A1 * 1/2005 Kawatsu et al. ..... 493/424
2006/0153612 A1 * 7/2006 Saitsu et al. ..... 399/410
2007/0161489 A1 * 7/2007 Ikeda et al. ..... 493/444
2008/0284092 A1 * 11/2008 Suzuki et al. ..... 271/244
2008/0315504 A1 * 12/2008 Terao et al. ..... 271/167
2009/0001648 A1 * 1/2009 Wakabayashi et al. .... 270/58.12
2009/0111673 A1 * 4/2009 Bober ..... 493/405
2011/0101591 A1 * 5/2011 Sano et al. ..... 270/20.1
2011/0103866 A1 * 5/2011 Imazu et al. ..... 400/578
2012/0275838 A1 * 11/2012 Imazu et al. ..... 400/578
2013/0063743 A1 * 3/2013 Matsuki et al. ..... 358/1.13

FOREIGN PATENT DOCUMENTS

JP S61-002637 1/1986
JP H11-106112 4/1999
JP 2006-076776 3/2006
JP 2007-320665 12/2007

(Continued)

*Primary Examiner* — Hemant M Desai
(74) *Attorney, Agent, or Firm* — Manabu Kanesaka

(57) ABSTRACT

In a sheet folding apparatus, to enable a jammed sheet to be removed with ease when a jam occurs, a casing having a carry-in entrance and a carrying-out exit is divided into an upper unit and a lower unit via a first transport path for carrying a sheet from the carry-in entrance to the carrying-out exit, a second transport path for performing folding processing on a sheet is disposed in the direction for crossing the first transport path, and in the upper unit are disposed a sheet front end switchback path for reversing and carrying the sheet toward a folding roller pair and sheet deflecting means for guiding the sheet to the folding roller pair. Then, the upper unit is coupled to the lower unit to be openable and closable by a hinge shaft rotating around one side end portion orthogonal to the sheet transport direction of the first transport path.

13 Claims, 24 Drawing Sheets

(56) References Cited

FOREIGN PATENT DOCUMENTS

| | | |
|---|---|---|
| JP | 2008-007297 | 1/2008 |
| JP | 2008-247531 | 10/2008 |
| JP | 2009-018494 | 1/2009 |

* cited by examiner

SHEET FOLDING AND IMAGE FORMATION APPARATUS

BACKGROUND OF THE INVENTION

1. Technical Field

The present invention relates to a sheet folding apparatus for folding a sheet fed from an image formation apparatus to feed to a post-processing apparatus, and more particularly, to improvements in the jam handling mechanism to remove a sheet jam.

2. Description of the Related Art

Generally, this type of sheet folding apparatus has been known as an apparatus for folding a sheet with an image formed thereon by an image formation apparatus such as a printing press, printer apparatus and copier in a predetermined fold position to perform finish processing.

For example, Japanese Patent Application Publication No. 2009-018494 proposes an apparatus in which a sheet folding apparatus is coupled to a sheet discharge outlet of an image formation apparatus, folds a sheet with an image formed for filing, and carries the sheet out to a subsequent binding processing apparatus (post-processing apparatus). In the document, the sheet folding apparatus is coupled to the sheet discharge outlet of the image formation apparatus, and a bookbinding processing apparatus is disposed on the downstream side of the sheet folding apparatus.

Not only such a system configuration in Japanese Patent Application Publication No. 2009-018494, it is known widely that part of an apparatus casing is configured to be openable and closable to open and close the path when a paper jam occurs in the transport path of sheets in the sheet folding apparatus. Such a structure is generally configured by hinge-coupling part of a casing to an apparatus frame to be openable and closable and exposing the sheet transport path to the outside with the casing opened.

Japanese Patent Application Publication No. S61-002637 discloses a post-processing apparatus and proposes a jam open/close mechanism for hinge-coupling one side end edge (for example, the apparatus left side end portion) orthogonal to the sheet transport direction in an apparatus for collating and collecting sheets fed from an image formation apparatus to perform binding processing.

More specifically, first, such a sheet folding apparatus as described above is known in Japanese Patent Application Publication No. 2009-018494, etc. The sheet folding apparatus is disposed between the image formation apparatus and the post-processing apparatus, and folds an image-formed sheet to feed to the post-processing apparatus. The sheet folding apparatus is provided with a transport path for carrying a sheet from a carry-in entrance to a carrying-out exit without performing folding processing on the sheet, and a folding processing path for performing the folding processing on a sheet to feed to the carrying-out exit.

Then, in the sheet folding apparatus disposed between the image formation apparatus and the prost-processing apparatus, an apparatus configuration is required which is small and compact as possible, and particularly, slim in the sheet feed direction. It is natural because the installation space of the entire system is reduced (narrowed).

Therefore, previously, the applicant of the invention conceived slimming the folding processing mechanism by placing a folding processing path for performing folding processing on a sheet fed from the carry-in entrance in the direction for crossing a transport path (through-pass path) for carrying a sheet from the carry-in entrance to the carrying-out exit without performing the folding processing, and filed the patent application (Japanese Patent Application No. 2009-291375). When a sheet jam occurs in such an apparatus configuration, the need arises for opening the transport path to remove the jam.

The inventor of the invention arrived at the idea that it is possible to retrieve jam sheets occurring in both paths, by dividing the configuration into two upper and lower portions with the through-pass path as a boundary and opening and closing the upper unit in the path configuration in which the folding processing path is disposed in the direction for crossing the through-pass path. Concurrently therewith, the inventor arrived at the idea that it is possible to reduce the size of the entire system without the image formation apparatus and the post-processing apparatus located at the front and back and the open/close space interfering with one another, by providing the upper unit with open/close motion around the hinge in the side end portion (apparatus rear side end portion) parallel with the sheet transport direction with respect to the lower unit.

Further, second, in Japanese Patent Application Publication No. S61-002637, when a sheet is jammed in a press-contact portion in a pair of folding rollers, the sheet transport mechanism is opened, and the sheet is pulled out with the sheet nipped between the rollers. Therefore, in a thin sheet or a sheet becoming wrinkled by the jam, part of the sheet may be broken and remain inside the apparatus. Alternately, in pulling out the sheet nipped between the rollers inside the apparatus, the operator may be injured.

Then, the inventor of the invention arrived at the idea that it is possible to release a plurality of press-contact portions by withdrawing a roller positioned in the center, and at the same time, restore to the original engagement relationship reliably in a folding roller mechanism in which a plurality of press-contact rollers is disposed around the roller positioned in the center.

OBJECT OF THE INVENTION

It is a principal object of the invention to provide a sheet folding apparatus that permits a jammed sheet to be removed with ease when the jam occurs in the sheet folding apparatus which is disposed between an image formation apparatus and a post-processing apparatus to perform folding processing on an image-formed sheet.

In other words, first, it is an object of the invention to provide a sheet folding apparatus which permits a jammed sheet to be removed with ease in a transport path for carrying a sheet to a folding processing position, without the open/close space to open and close part of the casing for the removal interfering with the apparatuses disposed on the upstream side and the downstream side, and which enables the apparatus to be made small and compact.

Further, second, it is another object to provide the sheet folding apparatus which enables a sheet jammed in a lower portion of the sheet folding apparatus for performing folding processing on a sheet to be reliably removed by simplified operation.

BRIEF SUMMARY OF THE INVENTION

To attain the aforementioned objects, in the invention, a casing having a carry-in entrance and a carrying-out exit is divided into an upper unit and a lower unit via a first transport path for carrying a sheet from the carry-in entrance to the carrying-out exit, a second transport path for performing folding processing on a sheet is disposed in the direction for crossing the first transport path, and in the upper unit are disposed a sheet front end switchback path for reversing and carrying the sheet toward a folding roller pair and sheet deflecting means for guiding the sheet to the folding roller pair. Then, the upper unit is coupled to the lower unit to be openable and closable by a hinge shaft rotating around one side end portion orthogonal to the sheet transport direction of the first transport path.

The upper unit is coupled to the lower unit to be openable and closable, in the upper unit are disposed an upper sheet guide of the first transport path and the sheet front end switchback path constituting part of the second transport path, and therefore, by opening the upper unit, it is possible to retrieve a jam sheet in each of the first and second transport paths. Accordingly, it is possible to retrieve a jam sheet arising in the path by simplified structure.

Further, the upper unit is coupled to the lower unit to rotate by the hinge shaft around one side end portion orthogonal to the sheet transport direction of the first transport path for guiding a sheet from the carry-in entrance to the carrying-out exit, and therefore, without the image formation apparatus and the post-processing apparatus respectively positioned on the upstream side and the downstream side in the sheet transport direction and open/close area of the upper unit interfering (overlapping) with one another, it is possible to reduce the size of the installation space of the entire system.

Furthermore, to attain the above-mentioned objects, in the invention, a plurality of rolls is brought into press-contact with a first roll positioned in the center in the order of the second, third and fourth rolls, and a guide member is provided which guides a folded sheet along the periphery of the first roll in between the third roll and the fourth roll.

Then, the first roll is provided in a first bracket member that swings in the direction separating from the second and third rolls, and the fourth roll and the guide member are provided in a second bracket member that swings in the direction separating from the first roll. Then, the first bracket member and the second bracket member are interlocked to swing in the separation direction by operating means provided in one of the members.

By separating the first roll positioned in the center from the second and third rolls, it is possible to concurrently release press-contact in the first folding press-contact portion and the second folding press-contact portion, and it is thereby possible to remove a jam sheet by simplified structure and operation. Concurrently therewith, it is possible to withdraw the fourth roll in press-contact with the first roll and the guide member at the same time in the separation direction. Accordingly, it is possible to withdraw the folding enhancement press-contact portion and the guide member therefor in conjunction with each other concurrently with the folding press-contact portions, and therefore, the jam handling is extremely simplified.

Further, the structure for the handling is that the first roll, and the fourth roll and guide member are respectively attached to the first bracket member and the second bracket member to be swingable in the separation direction, and that the first bracket member and the second bracket member are interlocked to swing in the separation direction by the operating means provided in one of the members, and it is thereby possible to release a plurality of press-contact portions by simplified structure and simplified operation.

By this means, in the sheet folding apparatus, when a jam occurs, it is possible to remove a jammed sheet with ease.

BRIEF DESCRIPTION OF THE SEVERAL VIEWS OF THE DRAWINGS

FIG. 6A is an explanatory view of principal part with the upper unit opened, and FIG. 6B is an explanatory view of a guide mechanism for open/close operation;

FIG. 13A is an explanatory view of a gate stopper mechanism, and FIG. 13B is an explanatory view of a pinch roller moving up/down mechanism of sheet transport means;

FIG. 18A shows a state in a waiting position, and FIG. 18B shows a state in an actuation position;

FIG. 19A shows a state in which a sheet is registered, and FIG. 19B shows a state in which a sheet is carried from a first path to a second path;

FIG. 20A shows a state in which a fold position of the sheet is inserted in a first nip portion, and FIG. 20B shows a state in which the first-folded sheet is fed to a second switchback path;

FIG. 21A shows an initial state in which the sheet undergoes second folding in a second nip portion, and FIG. 21B shows a state in which the sheet that is folded in the second nip portion is carried out in a sheet discharge direction;

FIG. 22A shows an aspect for performing inward three-folding on the sheet in a ⅓ position, FIG. 22B shows an aspect for performing outward three-folding on the sheet in a ⅓ position, FIG. 22C shows an aspect for performing Z-folding on the sheet in a ¼ position, FIG. 22D shows an inward three-folding aspect with the margin provided, and FIG. 22E shows an outward three-folding aspect with the margin provided;

DETAILED DESCRIPTION OF THE INVENTION

Figure 1:
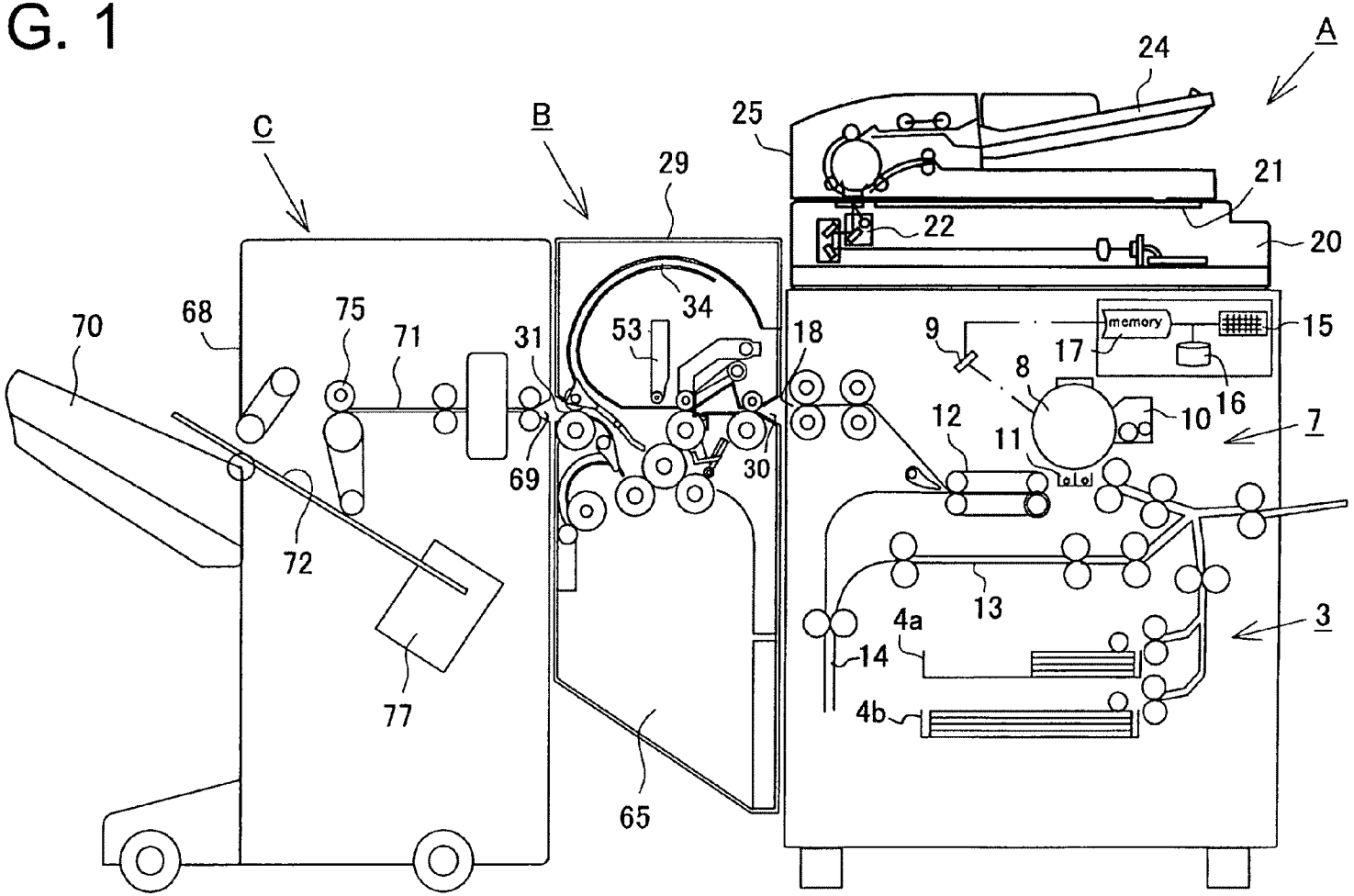
FIG. 1 is an explanatory view of an entire configuration of an image formation system provided with a sheet folding apparatus according to the invention.

The invention will specifically be described below based on Embodiments shown in the figures. FIG. 1 shows an image formation system provided with a sheet folding apparatus B according to the invention. This system is comprised of an image formation apparatus A and a post-processing apparatus C, and the post-processing apparatus C is installed with the sheet folding apparatus B as a unit.

The image formation apparatus A is configured as a printer, copier, printing press or the like for sequentially forming images on sheets. The apparatus as shown in FIG. 1 is comprised of an image formation section 7, original document reading section 20 and feeder section (original document feeding apparatus) 25 as a complex copying machine having the copier function and the printer function.

Further, the post-processing apparatus C is configured to perform post-processing such as folding processing, punching processing, sealing processing and binding processing on a sheet with an image formed in the image formation apparatus A. Then, the post-processing apparatus C is integrally provided with the sheet folding apparatus B for performing folding processing on a sheet with an image formed. The sheet folding apparatus B, image formation apparatus A and post-processing apparatus C will be described below in this order.

[Sheet Folding Apparatus]

The sheet folding apparatus B according to the invention is incorporated into the image formation apparatus A or the post-processing apparatus C, or is configured as an apparatus (stand-alone configuration) independent of the apparatuses. The apparatus as shown in the figure is disposed between the image formation apparatus A and the post-processing apparatus C as an optional unit.

Figure 3:
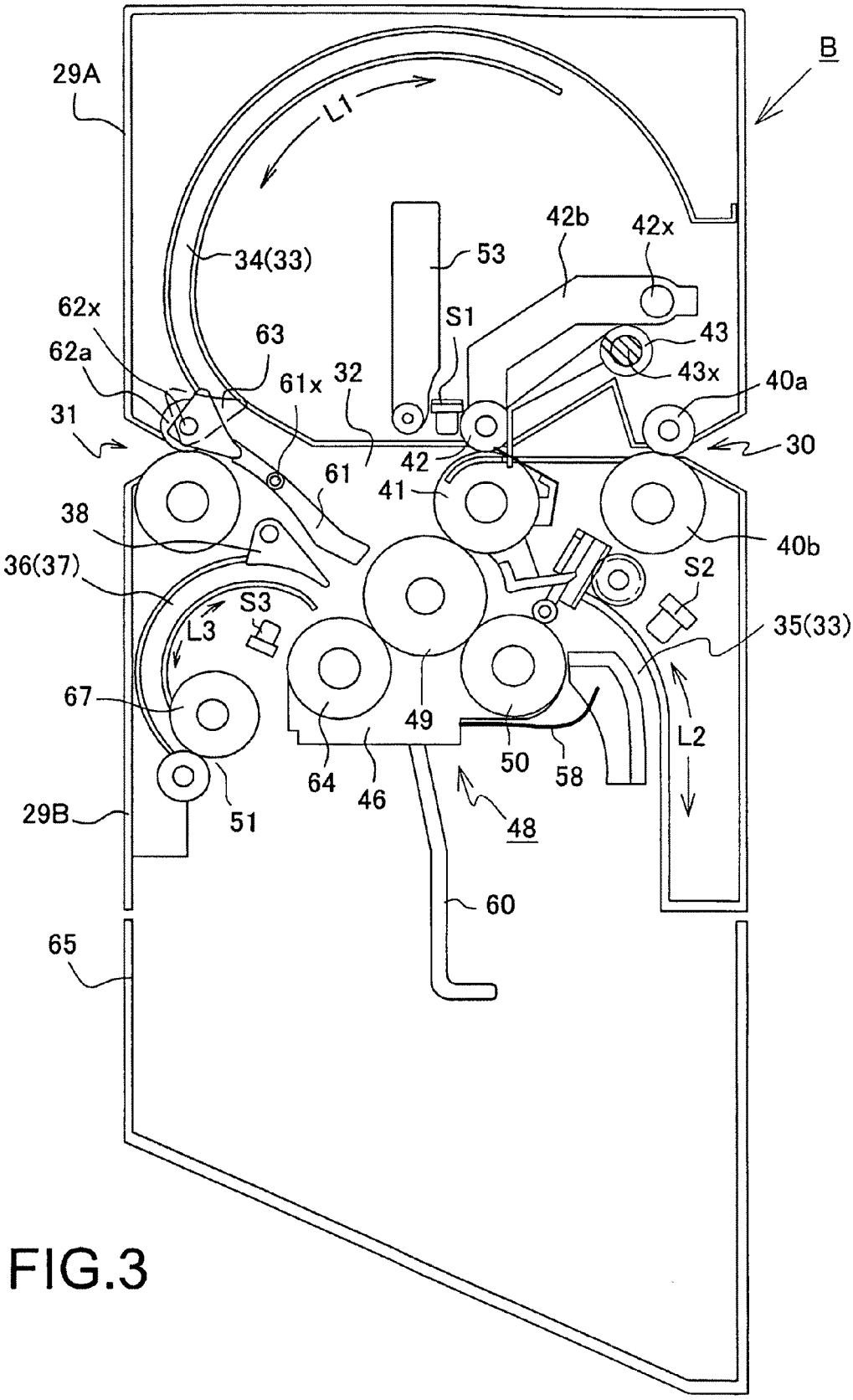
FIG. 3 is an explanatory view of an entire configuration of the sheet folding apparatus in the system of FIG. 1.

In the sheet folding apparatus B, as shown in FIG. 3 illustrating the entire configuration, a casing 29 is provided with a carry-in entrance 30 and a carrying-out exit 31, the carry-in entrance 30 is arranged in a position continued to a main-body sheet discharge outlet 18 of the image formation apparatus A on the upstream side, and the carrying-out exit 31 is arranged in a position continued to a sheet receiving opening 69 of the post-processing apparatus C on the downstream side. In addition, in the invention, there are cases that the sheet folding apparatus B is not provided with an independent casing 29, and for example, is incorporated into a casing of the post-processing apparatus C, and the cases do not require the carry-in entrance 30 and carrying-out exit 31.

Accordingly, in the following description, the carry-in entrance 30 is synonymous with a carry-in portion, the carrying-out exit 31 is synonymous with a carrying-out portion, and for convenience in description, the description is given while assuming that the carry-in portion is the carry-in entrance 30 and that the carrying-out portion is the carrying-out exit 31.

As shown in FIG. 3, the carry-in entrance 30 and carrying-out exit 31 are disposed opposite each other across the casing 29. The carry-in entrance 30 and carrying-out exit 31 shown in the figure are disposed in opposite positions in the substantially horizontal direction. Then, in between the carry-in entrance 30 and the carrying-out exit 31 are disposed a first transport path 32 (sheet transport path; the same in the following description) for carrying out a sheet from the carry-in entrance 30 to the carrying-out exit 31 without performing folding processing, and a second transport path 33 (folding processing path; the same in the following description) for performing the folding processing on a sheet from the carry-in entrance 30 to carry out to the carrying-out exit 31. A "sheet transport mechanism" for carrying a sheet in the predetermined direction (horizontal direction) is disposed in the first transport path 32, and a "folding processing mechanism" for performing the folding processing on a sheet is disposed in the second transport path 33.

[Casing Structure]

In the apparatus of FIG. 3, the casing 29 is comprised of an upper unit 29A and a lower unit 29B that are divided vertically via the first transport path 32 for guiding a sheet from the carry-in entrance 30 to the carrying-out exit 31 without performing folding processing.

Then, as shown in FIG. 3, in the upper unit 29A are disposed an upper sheet guide 32*a* constituting the first transport path 32, and a sheet front end switchback path 34 (first switchback path; the same in the following description) constituting the second transport path 33. Concurrently therewith, the upper unit 29A is provided with a carry-in roller 40*a*, gate stopper 43, pinch roller 42, and carrying-out roller 62*a*. The carry-in roller 40*a* and carrying-out roller 62*a* are supported by rotary shafts of the direction orthogonal to the sheet transport direction (the arrow direction in FIG. 2) of the first transport path 32.

The gate stopper 43 is configured to be swingable on a spindle 43*x* of the direction orthogonal to the sheet transport direction, as described later, and similarly, the pinch roller 42 is configured to be swingable on a spindle 42*x* of the direction orthogonal to the sheet transport direction.

Meanwhile, in the lower unit 29B are disposed a lower sheet guide 32*b* constituting the first transport path 32, folding roller pair (41, 49, 50), sheet discharge paths 36, 37, storage stacker 65, and sheet discharge roller 67.

Figure 5:
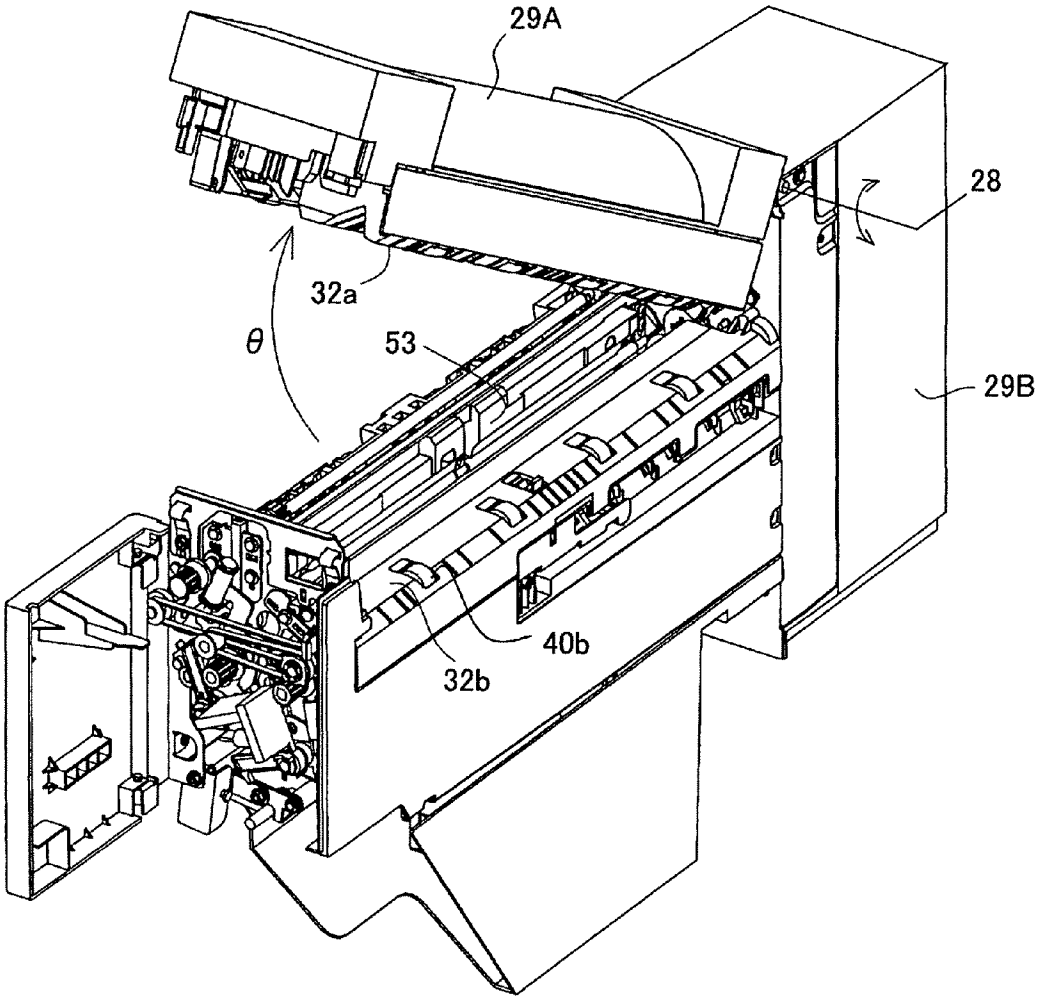
FIG. 5 is an explanatory view of a state in which an upper unit is opened in the sheet folding apparatus.

In addition, a first folding deflecting means 53 is provided in the lower unit 29B (see FIG. 5). Then, in the lower unit 29B are disposed a shift motor MS for moving the first and second folding deflecting means 53, 54 up and down, and a feeding motor Mf.

Figure 4:
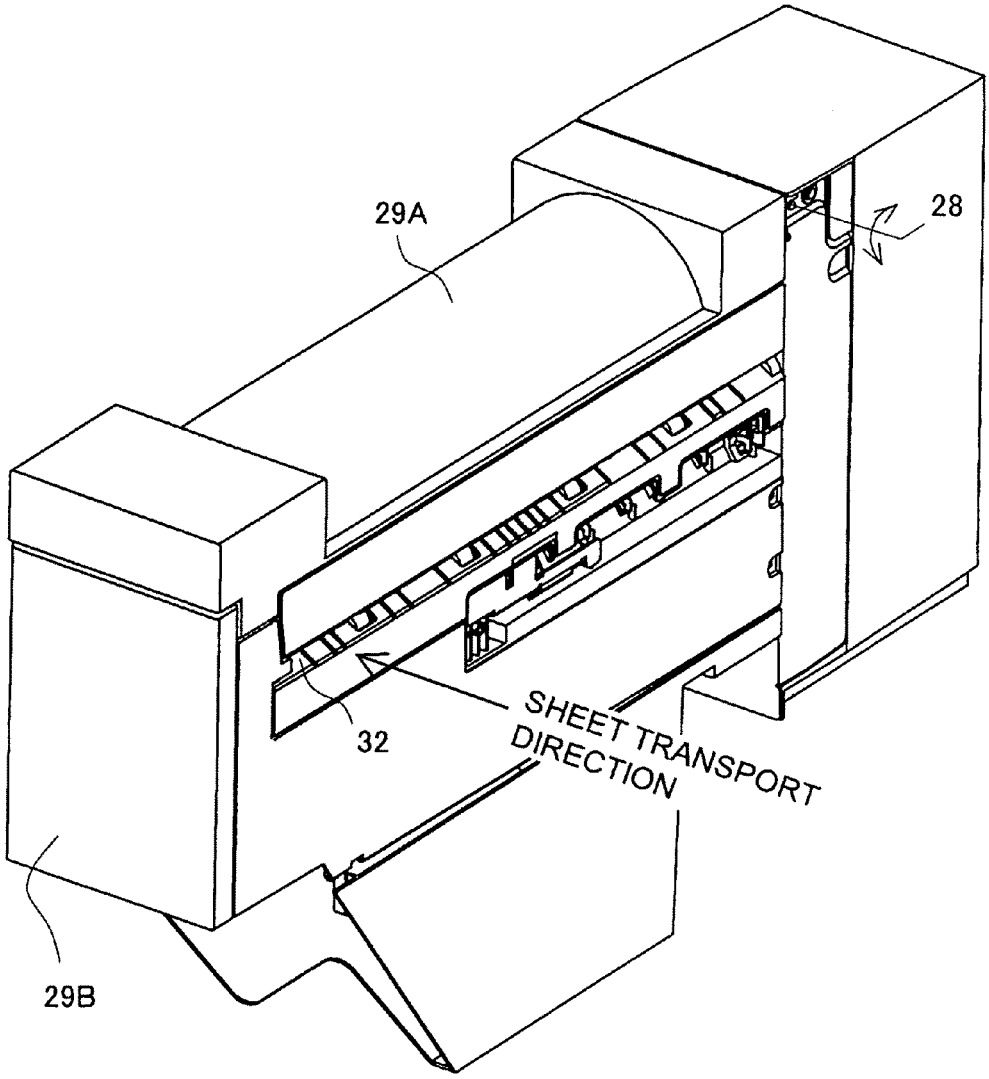
FIG. 4 is a perspective explanatory view showing a casing of the sheet folding apparatus.

In such a unit configuration, the upper unit 29A is coupled to the lower unit 29B to be openable and closable by the hinge shaft 28 around one side end portion orthogonal to the sheet transport direction of the first transport path 32. FIG. 4 shows a closed state, and FIG. 5 shows an open state. In this closed state, as shown in FIG. 3, the upper sheet guide 32*a* and lower sheet guide 32*b* are opposed to each other with a predetermined spacing and form the first transport path 32. Meanwhile, in the open state, the upper sheet guide 32*a* releases the path in the state of FIG. 5 at a predetermined angle of θ around the hinge shaft 28 with respect to the lower sheet guide 32*b*.

Figure 6A:
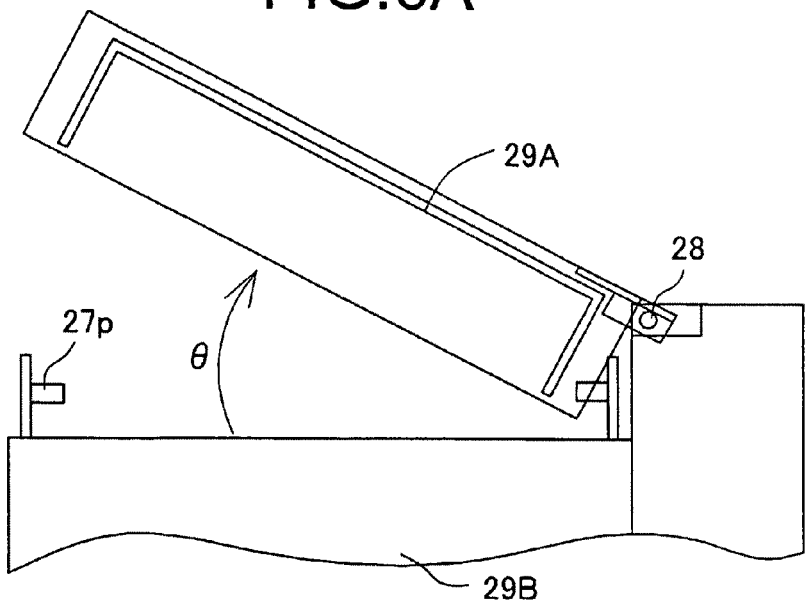
FIG. 6A and FIG. 6B contain explanatory views of a state in which the upper unit is opened and closed in the sheet folding apparatus, where
Figure 6B:
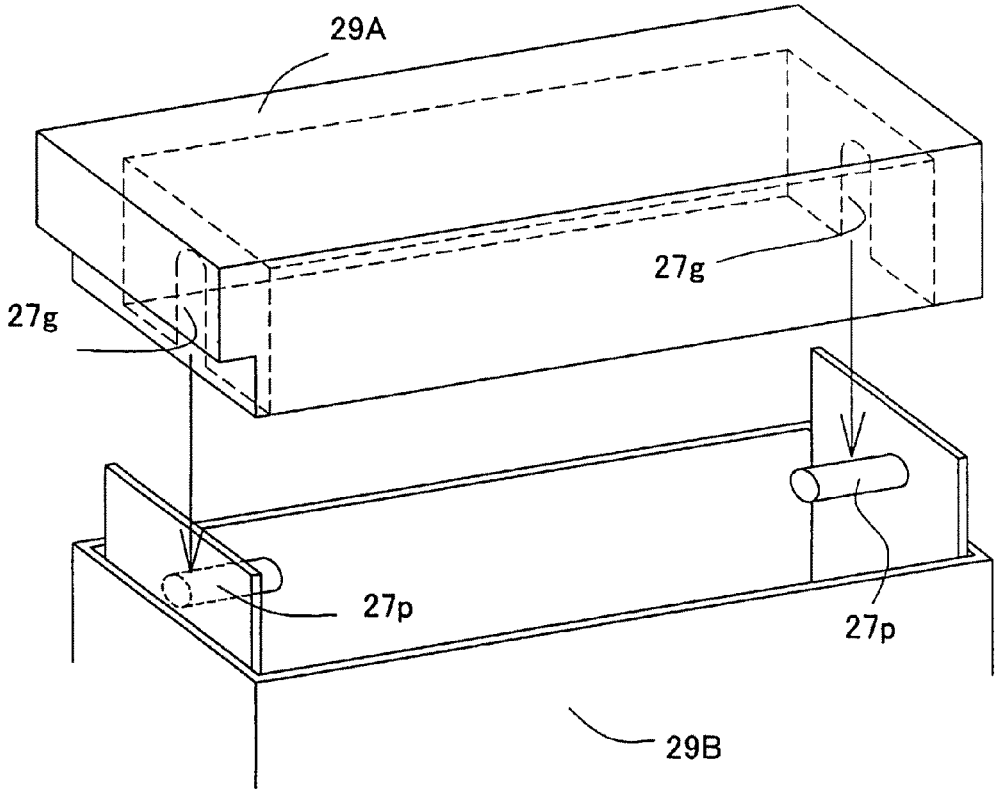

FIGS. 6A and 6B show a mechanism for guiding the open/close operation of the unit in operating the upper unit 29A to be opened and closed around the hinge shaft 28 with respect to the lower unit 29B. As shown in FIG. 6A, the upper unit 29A is opened and closed around the hinge shaft 28 with respect to the lower unit 29B. At this point, one of the upper unit 29A and lower unit 29B is provided with guide pins 27*p*, while the other one is provided with guide grooves 27*g*. Then, when open/close motion is performed around the hinge shaft 28, the guide pin 27*p* is guided along the guide groove 27*g*, and both of the units undergo the open/close motion in the correct position without rattling. In addition, in performing the open/close motion, it is necessary that the gate stopper mechanism and the driving system of the pinch roller mechanism are engaged and released, and the configuration will be described later.

Thus, the upper unit 29A is coupled to the lower unit 29B to be openable and closable, in the upper unit 29A are disposed the upper sheet guide 32*a* of the first transport path 32 and the first switchback path 34, and therefore, by opening the upper unit 29A, it is possible to retrieve a jam sheet in each of the first and second transport paths 32, 33. Accordingly, it is possible to retrieve a jam sheet arising in the path by simplified structure.

Further, the upper unit 29A is coupled to the lower unit 29B to rotate by the hinge shaft 28 around one side end portion orthogonal to the sheet transport direction of the first transport path 32, and therefore, without the image formation apparatus A and the post-processing apparatus C respectively positioned on the upstream side and the downstream side in the sheet transport direction and open/close area of the upper unit 29A interfering (overlapping) with one another, it is possible to reduce the size of the installation space of the entire system.

[Path Configuration]

As shown in FIG. 3, in the casing 29, the first transport path 32 is disposed between the carry-in entrance 30 and the carrying-out exit 31. This path may be a linear path disposed in the horizontal direction as shown in the figure, may be configured as a curved path, or may be disposed in the vertical direction, and it is possible to adopt any configuration. As described above, the first transport path 32 guides a sheet from the carry-in entrance 30 to the carrying-out exit 31 without performing the folding processing.

Further, the second transport path 33 is configured as a path for performing the folding processing on a sheet from the carry-in entrance 30. Therefore, the second transport path 33 branches off from the first transport path 32, and is configured to guide a sheet from the carry-in entrance 30 to sheet folding positions Np1 and Np2. Concurrently therewith, as shown in FIG. 3, the second transport path 33 is disposed in a direction in which the path 33 crosses the first transport path 32, and the first folding position Np1 and the second folding position Np2 are set in this path.

Then, the second transport path 33 is comprised of the first switchback path (first reverse path) 34 for guiding the sheet front end for first folding to the first folding position Np1, and a second switchback path (second reverse path) 35 for guiding the folded sheet front end to the second folding position Np2 to perform second folding on the folding-processed sheet.

Thus, the second transport path 33 is disposed in the direction to cross the first transport path 32, where the first switchback path 34 is disposed in the area above the first transport path 32, the second switchback path 35 for carrying a sheet from the cross portion to the downstream side (the direction of the second folding position Np2) is disposed in the area below the first transport path 32, and the paths 34 and 35 are thus configured to be opposed vertically.

Then, each of the first switchback path 34 and second switchback path 35 is comprised of a curved path and formed substantially in the shape of an S-curve as shown in FIG. 3. In the second transport path (folding processing path) 33, a folding processing section 48 described later is disposed in the first folding position Np1 and second folding position Np2, and the path 33 is connected to a sheet discharge path 36 for carrying out the folded sheet from the second folding position Np2 toward the carrying-out exit 31.

In addition, the first transport path 32 and the second transport path 33 are disposed to cross each other, and the first switchback path 34 for guiding the sheet to the first folding position Np1 may be disposed below the first transport path 32, while the second switchback path 35 for guiding the folding-processed sheet to the downstream side may be disposed above the first transport path 32.

Further, in the Embodiment of FIG. 3, the first transport path 32 is disposed in the horizontal direction, and when the first transport path 32 is disposed in the vertical direction in the casing 29, it is possible to arrange the first switchback path 34 and second switchback path 35 to the left and right areas of the first transport path 32 to be opposite each other.

Further, in the Embodiment as shown in FIG. 3, in relation to the second switchback path 35 guiding the folded sheet to the second folding position Np2 to perform second folding on the sheet, the path 35 is configured to reverse the feeding direction of the sheet, but when second folding is not performed on the sheet, the path 35 can be a path to extend straight, and in this case, the need is eliminated for providing the second switchback path as descried previously.

The second transport path 33 is connected to the sheet discharge path 36 for guiding the folding-processed sheet to the carrying-out exit 31. The sheet discharge path 36 shown in the figure is provided in between the second folding position Np2 for performing second folding on the sheet and the carrying-out exit 31. In the sheet discharge path 36 is disposed a sheet discharge path 37 for guiding the folded sheet to a storage stacker 65 from a sheet discharge outlet 51 different from the carrying-out exit 31.

Then, a path length (L1) of the first switchback path 34 for guiding a sheet from the first transport path 32 to the first folding position (first nip portion) Np1 and a path length (L2) of the second switchback path 35 for guiding the folded sheet subjected to first folding to the second folding position (second nip portion) Np2 are configured so that path length L1>path length L2.

A path length L3 of the sheet discharge path 37 for guiding the sheet further subjected to the folding processing to the storage stacker 65 from the second folding position Np2 is configured so that L3<L2<L1. This is because when the first folding position (first nip portion) Np1 is disposed near the first transport path 32, the path lengths are L3<L2<L1 as a result, and the path configuration is thereby made compact.

Accordingly, the first switchback path 34 with the long path length is disposed in the upper area of the first transport path 32, the second switchback path 35 and the sheet discharge path 37 with the short path lengths are disposed in the lower area opposite the upper area, and further, the storage stacker 65 is disposed below the second switchback path 35 and the sheet discharge path 37. By such a layout configuration, it is possible to make the inside space of the casing 29 compact.

[Path Switching Means]

The following path switching means 63 is disposed in the cross portion of the above-mentioned first transport path 32 and second transport path (folding processing path) 33. As described previously, the second transport path 33 branches off from the first transport path 32 and guides a sheet fed from the carry-in entrance 30 to the first and second folding positions Np1, Np2. Therefore, the path switching means 63 is disposed in the cross portion of the first and second transport paths 32 and 33. As shown in FIG. 3, a base end portion is axially supported by an apparatus frame (in the figure, spindle 62*x* of the carrying-out roller 62*a*) outside the path to be swingable.

Then, the path switching means 63 guides a sheet fed to the first transport path 32 to the first switchback path 34 of the second transport path 33 in the solid-line attitude in FIG. 3, while guiding a sheet fed to the first transport path 32 to the carrying-out exit 31 from the carrying-roller pair 62 in the dashed-line attitude in FIG. 3.

A sheet guide 61 is provided in the cross portion of the first transport path 32 and second transport path 33 together with the path switching means 63. The sheet guide 61 is disposed in between the second roller 41 and the carrying-out roller pair 62 in the first transport path 32, guides a sheet fed from the carry-in roller pair 40 to the second transport path 33, and concurrently therewith, guides a reversed sheet from the first switchback path 34 to the first folding position Np1. Further, the sheet guide 61 guides a sheet fed to the first transport path 32 to the carrying-out exit 31 from the carrying-out roller pair 62 without guiding the sheet to the second transport path 33.

Therefore, the sheet guide 61 is disposed in the cross portion with a relatively long transport span, and guides the sheet to the second transport path 33 side or carrying-out exit 31 side in cooperation with the path switching means 63 as described previously. In the apparatus as shown in the figure, as shown in FIG. 3, the guide 61 comprised of a guide plate supported swingably in the spindle 61*x* by the apparatus frame.

Figure 14:
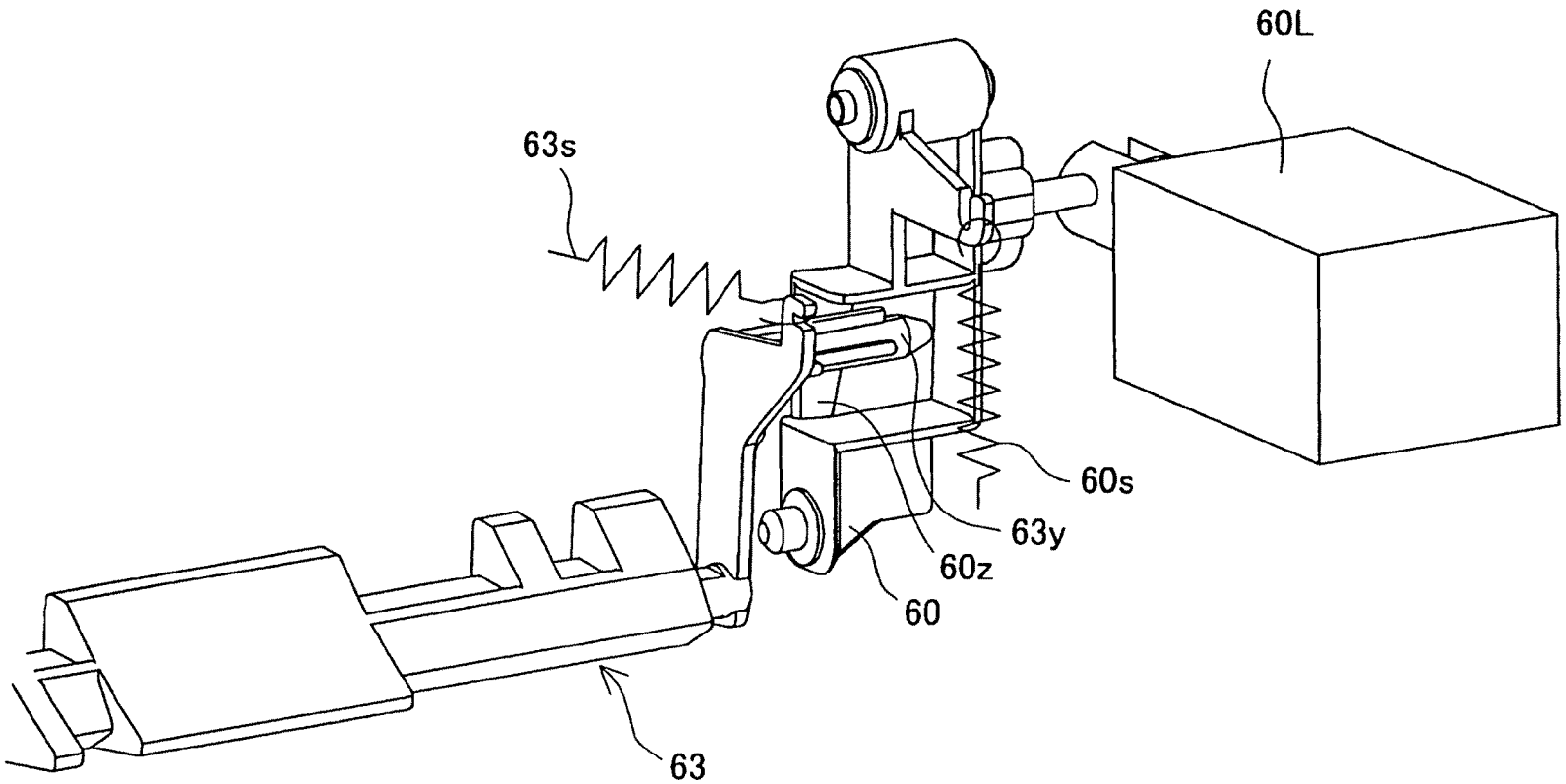
FIG. 14 is a detailed explanatory view of an engagement state of path switching means.

As shown in FIG. 14, a link lever 60 is axially supported swingably by the path switching means 63, and the link lever and path switching means 63 are integrally combined. Then, an electromagnetic solenoid 60L is coupled to a front end portion of the link lever 60, and a return spring 60*s* is extended in the direction in which the path switching means 63 guides a sheet to the second transport path 33 side.

Accordingly, when the electromagnetic solenoid 60L is ON, the path switching means 63 is positioned in the first attitude (attitude for guiding a sheet to the second transport path 33). Further, when the electromagnetic solenoid 60L is turned OFF, the link lever 60 rotates in a counterclockwise direction shown in the figure on the spindle 62*x* as the center by action of the return spring 60*s*, and positions the path switching means 63 in the second attitude (attitude for guiding a sheet to the carrying-out exit 31).

Further, the path switching means 63 is disposed in the upper unit 29A to be swingable between the first guide attitude facing the first transport path 32 and the second attitude shifted outside the path. The path switching shift means for swinging the path switching means 63 between the first guide attitude and the second guide attitude is comprised of a swing member (actuation lever) 63*y* integrally provided in the swing spindle, and the lever member 60 that engages in the swing member. Then, the lever member 60 has an engagement surface that engages in the swing member, and a guide surface 60*z* for guiding the engagement surface to the swing member 63*y* when the upper unit A rotates around the hinge shaft 28.

[Configuration of Folding Rollers]

In the second transport path 33 are disposed the second roller 41, first roller 49 and third roller 50 to come into press-contact with one another. The first nip portion (first folding position) Np1 for first folding the sheet is formed in a press-contact point between the second roller 41 and first roller 49, and the second nip portion (second folding position) Np2 for second folding the sheet is formed in a press-contact point between the first roller 49 and the third roller 50.

Meanwhile, in the roller diameter of each of the first, second and third rollers, the first roller diameter is the maximum, and for example, 30 mm, the second and third roller diameters are 20 mm, and the first roller 49 positioned in the center is configured to have the maximum diameter (for example, 1.5 time). This is because of configuring the folding portion front end to be compact by arranging the second roller 41 and third roller 50 around the periphery of the first roller 49 in the shape of satellites. In other words, with respect to the first roller 49 with the large diameter, the second roller 41 with the small diameter is brought into press-contact on the upstream side, the third roller 50 with the small diameter is brought into press-contact on the downstream side, and thereby, the first nip portion Np1 for first folding and the second nip portion Np2 for second folding are formed.

Further, the second roller 41 is disposed in the position such that part of the periphery faces the first transport path 32, and the pinch roller 42 is brought into press-contact with the periphery of the roller 41. By this means, the sheet in the first transport path 32 is fed to the downstream side by the second roller 41 and pinch roller 42, and it is not necessary to provide the first transport path 32 with specific transport means and driving mechanism thereof.

[Configuration of the Folding Deflecting Means]

In the folding roller means comprised of three rollers (41, 49, 50) as described above, the first folding deflecting means 53 is disposed in the first nip portion Np1, and the second folding deflecting means 54 is disposed in the second nip portion Np2. The first folding deflecting means 53 and the second folding deflecting means 54 are formed of a mechanism that fold positions of the sheet fed to the second transport path 33 are inserted in the first nip portion Np1 and the second nip portion Np2.

In the apparatus as shown in the figure, the first folding deflecting means 53 and the second folding deflecting means 54 are provided with the function of "inserting the fold position of the sheet in a roller nip portion" and the function of "feeding the front end and rear end of the sheet to the nip portion". Therefore, the first and second folding deflecting means 53, 54 are respectively provided with driven rollers 53*a*, 54*a* and curved guides 53*b*, 54*b* and are configured to shift to positions from a withdrawal position outside the path to an actuation position inside the path. Then, by the operation of the driven roller and curved guide shifting from the withdrawal position to the actuation position, the fold position of the sheet is inserted in the nip portion, and then, the driven roller comes into press-contact with the periphery of the folding roller to rotate by being driven, and thereby acts to feed the front and rear ends of the sheet to the nip portion.

[Configuration of the First Folding Deflecting Means]

Figure 7:
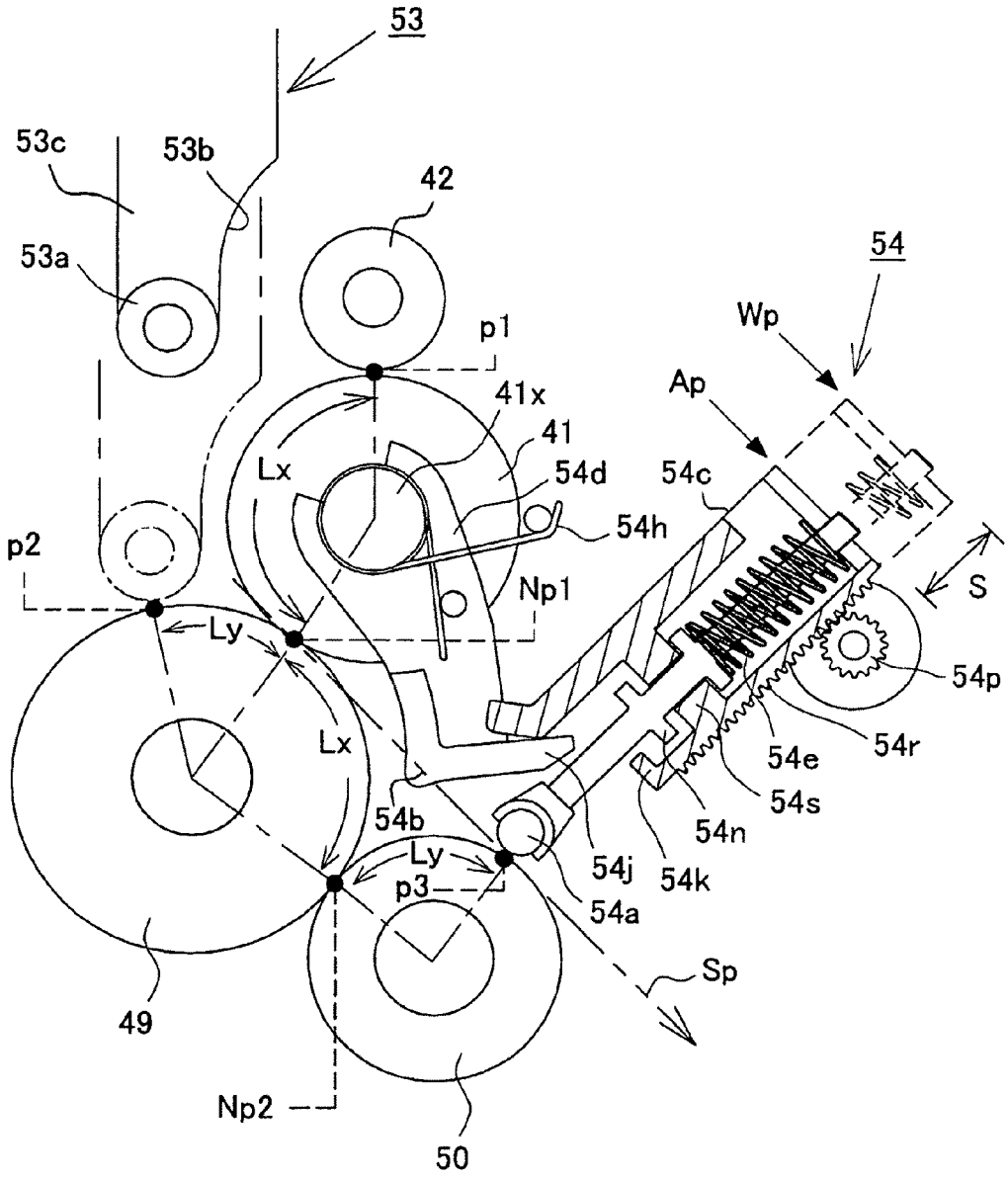
FIG. 7 is an explanatory view showing a layout configuration of folding rollers of FIG. 3 and second folding deflecting means.

As shown in FIG. 7, to guide the fold of the sheet to the first nip portion (press-contact point) Np1, the first folding deflecting means 53 is comprised of the driven roller 53*a*, curved guide 53*b* and up-and-down member 53*c*.

As shown in FIG. 7, the first nip portion Np1 for first folding the sheet is comprised of the second roller 41 and first roller 49, the second roller 41 is disposed on the upstream side, and the first roller 49 is disposed on the downstream side. Thus, the driven roller 53*a* is disposed in a position for coming into contact with the periphery of the first roller 49. Then, the curved guide 53*b* is configured to be a curved surface along the periphery of the second roller 41 positioned on the upstream side.

The driven roller 53*a* and the curved guide 53*b* are supported by the up-and-down member 53*c*. The up-and-down member 53*c* is comprised of a bracket member (frame member) of an appropriate shape, the driven roller 53*c* is supported rotatably by the up-and-down member 53*c*, and concurrently, the curved guide 53*b* is fixed to the member 53*c*. Then, the up-and-down member 53*c* is supported by a guide rail (not shown) provided in the apparatus frame, and is configured to move up and down between an actuation position (dashed-line position in FIG. 7) in which the driven roller 53*a* comes into contact with the periphery of the first roller 49, and a waiting position (solid-line position in FIG. 7) in which the driven roller 53*a* retracts out of the second transport path 33. The up-and-down member 53*c* is coupled to a shift motor MS described later, and shifts positions of the driven roller 53*a* and curved guide 53*b* between the actuation position and the waiting position.

The above-mentioned driven roller 53*a* comes into press-contact with the first roller 49 positioned on the downstream side, and the press-contact point is shown by p2 in FIG. 7. Then, when the fold position of the sheet is guided to the first nip portion Np1, the rear end side of the sheet is provided with the transport force in the press-contact point p1, and is guided to the first nip portion Np1 along the periphery of the second roller 41. Further, the front end side of the sheet is provided with the transport force in the press-contact point p2, and is guided to the first nip portion Np1 along the periphery of the first roller 49.

At this point, the transport length Lx between the press-contact point p1 and the first nip portion Np1 and the transport length Ly between the press-contact point p2 and the first nip portion Np1 are set at Lx>Ly. The position of the driven roller 53*a* is set in such a transport length relationship. Then, the curved guide 53*b* forms the curved guide surface in the shape of a curve along the periphery of the second roller 41 with the longer transport length.

In other words, conventionally, the blade member for guiding a fold of the sheet to the nip portion (Np1, Np2) has been provided separately from the sheet feeding means, and has become a cause of displacement of the fold or wrinkle occurring in the sheet when timing for acting on the sheet deviates. To solve the problem, in the apparatus as shown in the figure, the transport length Lx of the second roller 41 on the upstream side of the sheet fed to the first nip portion Np1 and the transport length Ly of the first roller 49 on the downstream side are set at [Lx>Ly], concurrently the curved guide surface of the curved guide 53*b* is configured in the shape for bringing the sheet along the periphery of the second roller 41 with the longer transport length, and the driven roller 53*a* and the curved guide 53*b* are concurrently shifted from the waiting position to the actuation position.

By thus configuring, it is possible to guide the fold of the sheet correctly to the first nip portion Np1 without using particular folding blade means.

[Configuration of the Second Folding Deflecting Means]

The second folding deflecting means 54 will be described next. As shown in FIG. 7, the second folding deflecting means 54 is comprised of an up-and-down member 54*c*, driven roller 54*a* attached to the member 54*c*, and curved guide 54*b*. The driven roller 54*a* is disposed in a position opposite the periphery of the third roller 50 positioned on the downstream side of the first roller 49, and the curved guide 54*b* is disposed in a position opposite the periphery of the first roller 49 positioned on the upstream side.

Concurrently therewith, the driven roller 54*a* and the curved guide 54*b* are configured to shift to positions between a withdrawal position Wp withdrawn from the carrying path (hereinafter, referred to as a sheet path Sp; see FIG. 7) of the sheet and an actuation position Ap entering inside the sheet path Sp by the up-and-down member 54*c*.

The up-and-down member 54*c* is provided with a sleeve 54*s*, and a support stem of the driven roller 54*a* is fitted with the sleeve 54*s* slidably. Thus, the driven roller 54*a* is fitted and supported by the up-and-down member 54*c* reciprocating in the predetermined stoke S, and shifts to positions between the withdrawal position Wp and the actuation position Ap by the up-and-down member 54*c* shifting.

Then, an adjuster spring 54*e* is provided between the driven roller 54*a* fitted with the sleeve 54*s* and the up-and-down member 54*c*, and the driven roller 54*a* is biased in the direction of the third roller 50 by the adjuster spring 54*e*. Concurrently therewith, an engagement protrusion 54*k* is integrally provided in the up-and-down member 54*c*. The engagement protrusion 54*k* engages in a flange portion 54*n* of the support stem.

Meanwhile, the curved guide 54*b* is swingably supported by the apparatus frame. The guide as shown in the figure is integrally formed in a bracket 54*d* freely fitted with a rotary shaft 41*x* of the second roller 41, and the guide surface of the curved guide 54*b* is disposed in a position opposite the periphery of the first roller 49. Then, the curved guide 54*b* is engaged to shift to positions between the withdrawal position Wp withdrawn from the sheet path Sp and the actuation position Ap entering inside the path in conjunction with reciprocating motion of the up-and-down member 54*c*.

Therefore, the bracket 54*d* is provided with a biasing spring 54*h* for biasing toward the withdrawal position Wp and an engagement piece 54*j*. The engagement piece 54*j* engages with the up-and-down member 54*c*, and is configured to shift from the withdrawal position Wp to the actuation position Ap in conjunction with the shift of the up-and-down member 54*c* (against the biasing spring 54*h*).

In the above-mentioned configuration, the up-and-down member 54*c* and the shift motor MS constitute the shift means for shifting the driven roller 54*a* and curved guide 54*b* to positions between the withdrawal position Wp and the actuation position Ap. Further, as a substitute for the configuration of the up-and-down member 54*c* reciprocating in a predetermined stroke, it is naturally possible to constitute the shift means using an actuator such as an actuation solenoid. In this case, the driven roller 54*a* and the curved guide 54*b* are coupled to a single actuation solenoid, or individual actuation solenoids.

[Sheet Transport Mechanism]

The sheet transport mechanism of the first transport path 32 ad second transport path 33 will be described according to FIG. 3. In the first transport path 32, the carry-in roller pair 40 is disposed in the carry-in exit (carry-in portion) 30, the carrying-out roller pair 62 is disposed in the carrying-out exit (carrying-out portion) 31, and a register roller is disposed between the rollers. The register roller shown in the figure is comprised of the periphery of the second roller 41 described later and the pinch roller 42 in press-contact with the roller 41.

Accordingly, in the first transport path 32 are disposed the carry-in roller pair 40, carrying-out roller pair 62 and register roller (second roller) 41.

Then, the carry-in roller pair 40 is comprised of a pair of rollers 40*a*, 40*b*, and one of the rollers, 40*b*, is coupled to the feeding motor Mf described later. Similarly, the carrying-out roller pair 62 is comprised of a pair of rollers 62*a*, 62*b*, and one of the rollers, 62*b*, is coupled to the feeding motor Mf. Further, the pinch roller 42 is disposed to, rotate in accordance with the second roller 41, and the second roller 41 is also coupled to the feeding motor Mf.

In the second transport path (folding processing path) 33 are disposed the second roller 41, first roller 49 and third roller 50 coming into press-contact with one another, and the sheet discharge roller pair 67 is disposed in the sheet discharge path 37. Then, as shown in FIG. 3, the second transport path 33

(first switchback path 34 and second switchback path 35) is not provided with any sheet transport mechanism.

Then, to the second transport path 33, the sheet is carried in the first switchback path 34 by the carry-in roller pair 40 and the register roller (second roller) 41 disposed in the first transport path 32, and is fed to the downstream side by the first and second rollers 49, 41.

The apparatus shown in the figure is characterized by simplifying the sheet transport mechanism disposed in the first and second transport paths 32, 33 and thereby reducing the size, noise and power consumption of the apparatus. Therefore, in the first transport path 32, part of the periphery of the folding roller (second roller 41) disposed in the second transport path 33 is arranged to face the first transport path 32 in between the carry-in roller pair 40 and the carrying-out roller pair 62.

Then, the pinch roller 42 is disposed around the periphery of the second roller 41 to carry the sheet fed from the carry-in roller pair 40 to the first switchback path 34. By this means, it is not necessary to provide a specific transport roller in the first transport path 32, and it is possible to achieve simplification of the transport mechanism.

Concurrently therewith, the second roller 41 is rotated in performing the folding processing on the sheet in a mode for carrying the sheet from the carry-in roller pair 40 to the first switchback path 34 by the carry-in roller pair 40 and the second roller 41, while being halted so that the sheet is fed from the carry-in entrance 30 to the carrying-out exit 31 by the carry-in roller pair 40 and the carrying-out roller pair 62 in a mode for carrying a sheet from the carry-in entrance 30 to the carrying-out exit 31 without performing the folding processing on the sheet. By this means, it is possible to achieve reductions in power consumption and low-noise operation.

[Configuration of the Folding Processing Section]

As described previously, the folding processing section 48 is comprised of first, second, third and fourth rollers 49, 41, 50, 64 coming into press-contact with one another. Then, with the first roller 49 positioned in the center, the second roller 41, third roller 50 and fourth roller 64 are disposed in this order along the rotation direction of the roller 49. Further, between the third roller 50 and the fourth roller 64 is disposed a guide member 39 for guiding a folded sheet along the periphery of the first roller 49.

Then, a sheet undergoes first folding in the press-contact portion Np1 of the second roller 41 and the first roller 49, the sheet undergoes second folding in the press-contact portion Np2 of the first roller 49 and the third roller 50 on the downstream side, and then, the folded sheet undergoes folding enhancement in the press-contact portion Np3 of the first roller 49 and the fourth roller 64.

Figure 8A:
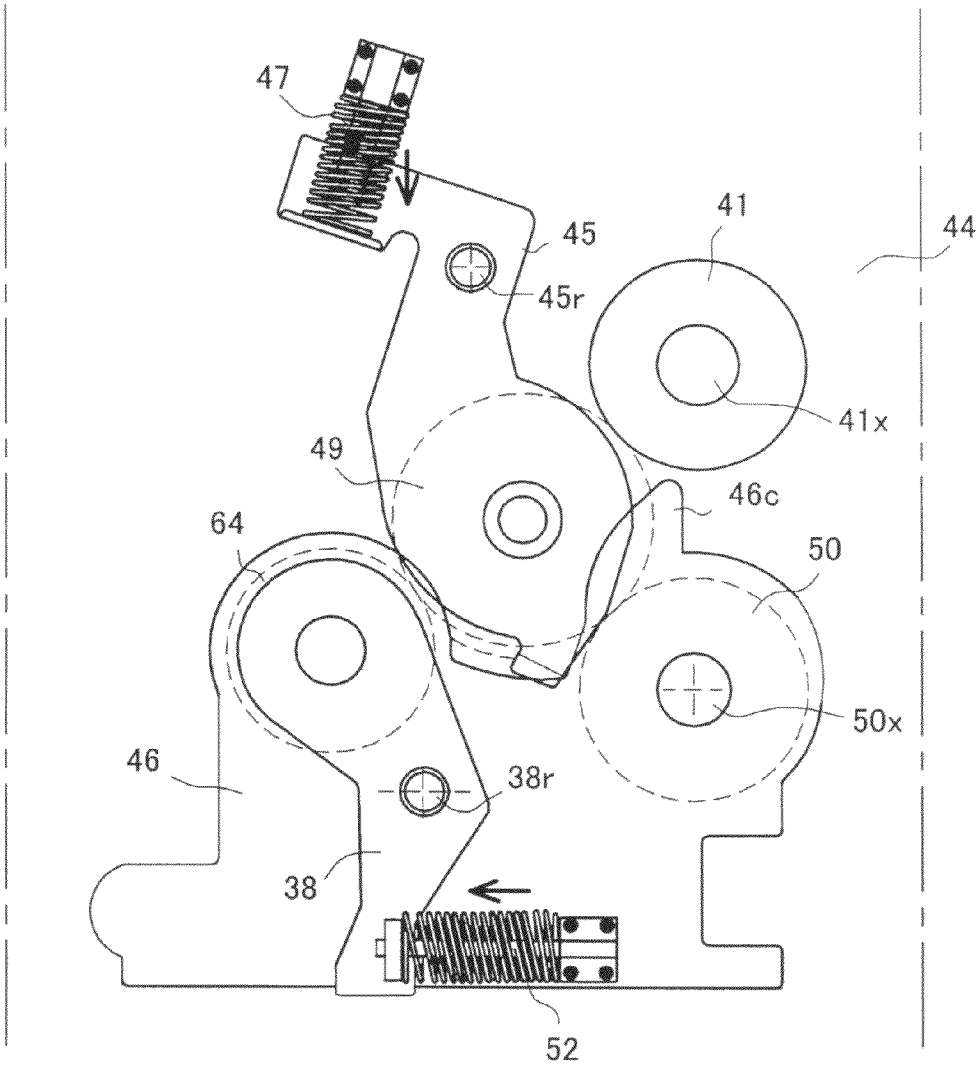
FIG. 8A shows a configuration explanatory view of a folding processing section.
Figure 8B:
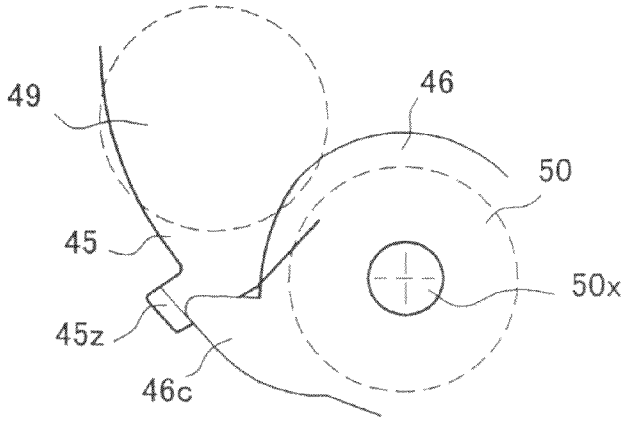
FIG. 8B is an enlarged explanatory view of a cam engagement portion of a bracket member.

The apparatus configuration of the above-mentioned folding processing section 48 will be described below. "44" shown in FIG. 8A denotes the apparatus frame, and FIG. 8A shows the front side of mutually opposite front and back side frames (front and back in the sheet of FIG. 8) of the apparatus housing. Each of the rollers 49, 41, 50 and 64 is rotatably supported between the front and back side frames (hereinafter, the pair of front and back side frames are simply referred to as the "apparatus frame") 44.

At this point, the first roller 49 is supported by the apparatus frame 44 via a first bracket member 45, and concurrently therewith, the fourth roller 64 is supported by the apparatus frame 44 via a second bracket 46. Further, the guide member 39 is supported by the second bracket member 46.

This is because the first bracket member 45 separates the first roller 49 from the second and third rollers 41, 50, and the second bracket member 46 separates the fourth roller 64 from the first roller 49.

Figure 9:
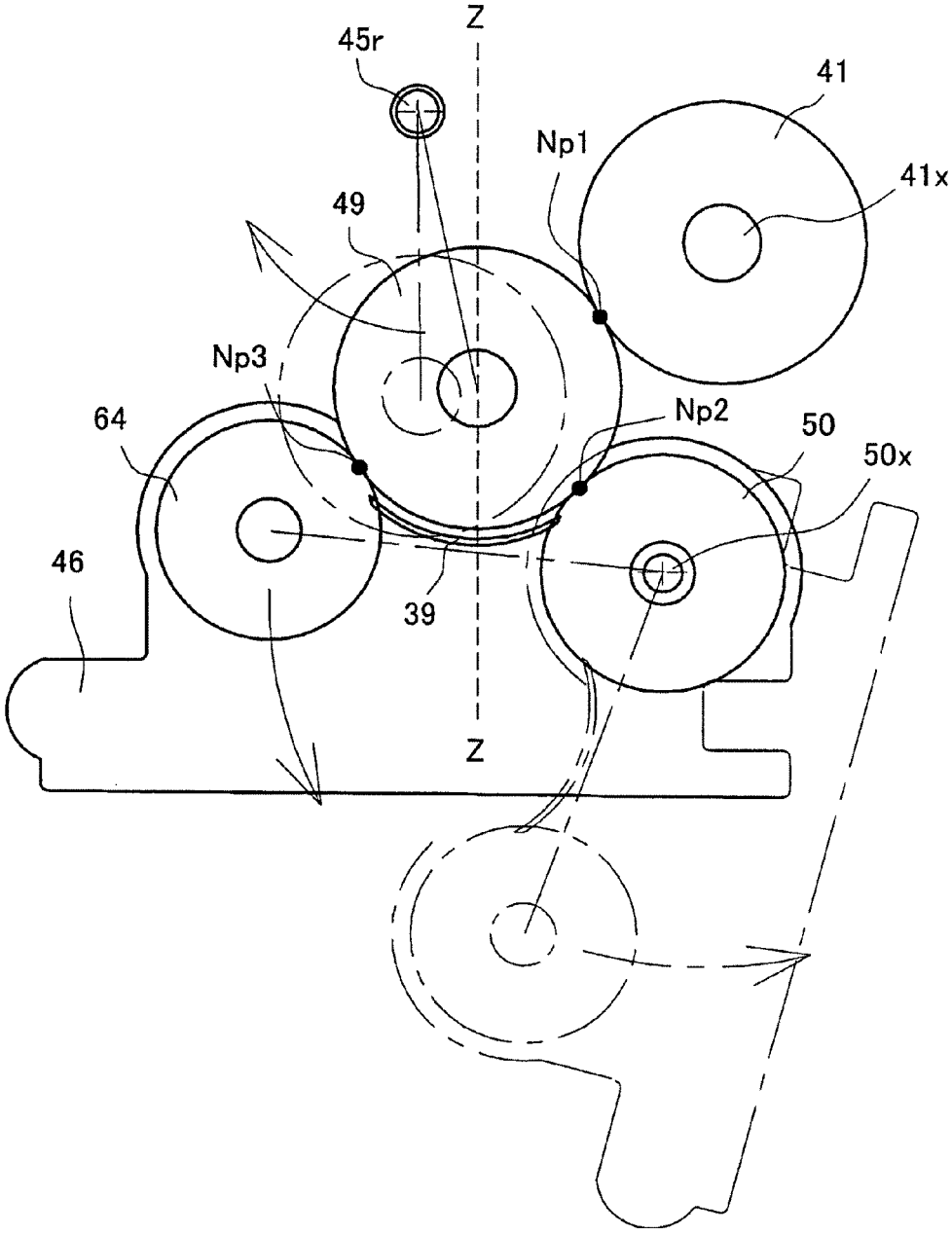
FIG. 9 is a conceptual view showing press-contact and separation states of folding roller means.

Therefore, as shown in FIG. 9, in the invention, the position relationship of the first to fourth rollers 49, 41, 50, 64 is configured as described below. On the periphery of the first roller 49, the second and third rollers 41, 50 are brought into press-contact with the right hemisphere portion (angular interval within 180 degrees), and the fourth roller 64 is brought into press-contact with the left hemisphere portion (angular interval beyond 180 degrees). In FIG. 9, with reference to the vertical line z-z, the second and third rollers 41, 50 are brought into press-contact with the right side within 180 degrees, while the fourth roller 64 is brought into press-contact with the left side within 180 degrees.

From such an arrangement relationship, in other words, using the vertical line z-z passing through the circle center of the first roller 49 as a base point, the second roller 41 and third roller 50 are disposed around the periphery of the first roller at angular positions in the range of 0 to 180 degrees, and similarly, the fourth roller 64 is brought into press-contact at an angular position in the range of 180 degrees to 360 degrees. By this means, the second and third rollers 41, 50 are fixed to the apparatus frame, the first and fourth rollers 49, 64 are shifted in position, and it is thereby possible to release press-contact in three locations at the same time. Further, by placing the second and third rollers 41, 50 in the right hemisphere portion of the first roller 49, and further placing the fourth roller 64 in the left hemisphere portion, it is possible to configure the roller mechanism to be small and compact.

Therefore, the second and third rollers 41, 50 are bearing-supported by the apparatus frame 44 at an angular interval of 180 degrees or less. In FIG. 9, the rotary shaft 41*x* of the second roller 41 is bearing-supported by the apparatus frame 44 to be rotatable, and similarly, a rotary shaft 50*x* of the third roller 50 is also bearing-supported.

Meanwhile, the first roller 49 is bearing-supported by the first bracket member 45, and the bracket member 45 is supported at a spindle 45*r* by the apparatus frame 44. The spindle 45*r* is set at the center position to swing the first roller 49 in the direction in which the roller 49 separates from the second and third rollers 41, 50.

Then, the first bracket member 45 is acted upon by the spring force in the arrow direction shown in the figure from the biasing spring (biasing means) 47 fixed at its one end to the apparatus frame 44, and brings the first roller 49 into press-contact with the second and third rollers 41, 50.

Meanwhile, the fourth roller 64 is attached to the second bracket member 46, and the second bracket member 46 is supported swingably at the spindle by the apparatus frame 44. To the second bracket member 46 is fixed the guide member 39, and the guide member 39 is formed in the shape of a curve for guiding the folded sheet along the periphery of the first roller 49 in between the third roller 50 and the fourth roller 64.

In the second bracket member 64, the position of the spindle is set in the apparatus frame 44 to be swingable in the direction in which the fourth roller 64 and the guide member 39 separate from the first roller 49. In the bracket shown in the fig ure, the spindle is set at the rotary shaft 50*x* of the third roller 50. The spindle may be set at the position other than the rotary shaft 50*x*.

The fourth roller 64 is not directly attached to the second bracket member 46, and is bearing-supported by the biasing lever 38 attached to the bracket. As shown in FIG. 8A, in the biasing lever 38, the front end axially supports the fourth roller 64, the center portion is axially supported at the spindle 38*r* by the second bracket member 46 to be rotatable, and a biasing spring 52 engages in the base end portion. The biasing spring 52 is at its one end fixed and supported by the second bracket member 46, and acts the spring force in the arrow direction on the biasing lever 38. By this spring force, the fourth roller 64 is brought into press-contact with the first roller 49.

Then, when the first bracket member 45 swings in a clockwise direction in FIG. 9 on the spindle 45*r*, the first roller 49 separates from the second and third rollers 41, 50. Meanwhile, when the second bracket member 46 swings in a counterclockwise direction in FIG. 9 on the rotary shaft 50*x*, the fourth roller 64 and the guide member 39 separate from the first roller 49.

In addition, in this case, after the second bracket 46 is shifted to the position in the direction in which the fourth roller 64 separates from the first roller 49, it is necessary to shift the first bracket member 45 to the position in the direction in which the fourth roller 64 separates from the first roller 49. This is because of preventing the fourth roller 64 from interfering with the movement of the first roller 49 when the first roller 49 shifts in the separation direction (see FIG. 9).

By thus separating the first roller 49 positioned in the center from the second and third rollers 41, 50, it is possible to concurrently release press-contact of the first folding press-contact portion Np1 and the second folding press-contact portion Np2, and it is thus possible to remove a jam sheet by the simplified structure and operation. Concurrently therewith, it is possible to withdraw the fourth roller 64 and guide member 39 in press-contact with the first roller 49 at the same time in the separation direction. Accordingly, concurrently with the folding press-contact portions, it is possible to withdraw the folding enhancement press-contact portion Np3 and the guide member 39 for the portion Np3 in conjunction with each other, and therefore, jam handing is remarkably made ease.

The operating means 55 is provided in one of the first and second bracket members 45, 46, and the members are interlocked so that when one of the members is swung, the other member also swings at the same time. In the members as shown in the figure, when the second bracket member 46 swings on the rotary shaft 50*x*, a cam engagement portion 46*c* provided in the member 46 presses an interlocked engagement portion 45*z* of the first bracket member 45, and swings the first bracket member 45 on the spindle 45*r* in the clockwise direction in FIG. 9.

The apparatus as shown in the figure indicates the case that the operating means 55 is provided in the second bracket member 46, the second bracket member 46 is provided with a latch 56 for holding the member 46 in the press-contact position, and when the latch is released, the second bracket member 46 is able to swing on the rotary shaft 50*x* in the counterclockwise direction in FIG. 9.

The latch 56 is comprised of a cam lever 56*a* and a latch groove 46*w*. The cam lever 56*a* is provided rotatably on the apparatus frame side, and is integrally provided with an operating lever (first operating lever) 56*b*. Then, in a state of FIG. 11A in which the front end of the cam lever 56*a* engages in the latch groove 46*w*, the second bracket member 46 is positioned in an actuation position (attitude).

Then, when the operating lever 56*b* is operated and the cam lever 56*a* rotates in a clockwise direction as shown in the figure, the cam lever front end is disengaged from the latch groove 46*w*, and the second bracket member 46 rotates freely on the rotary shaft 50*x* (free state).

The second bracket member 46 is provided with a temporary latch 57. For the temporary latch 57, one of engagement hooks 57*a*, 57*b* that mutually engage is disposed on the apparatus frame side, while the other one is disposed on the second bracket member side.

Figure 11A:
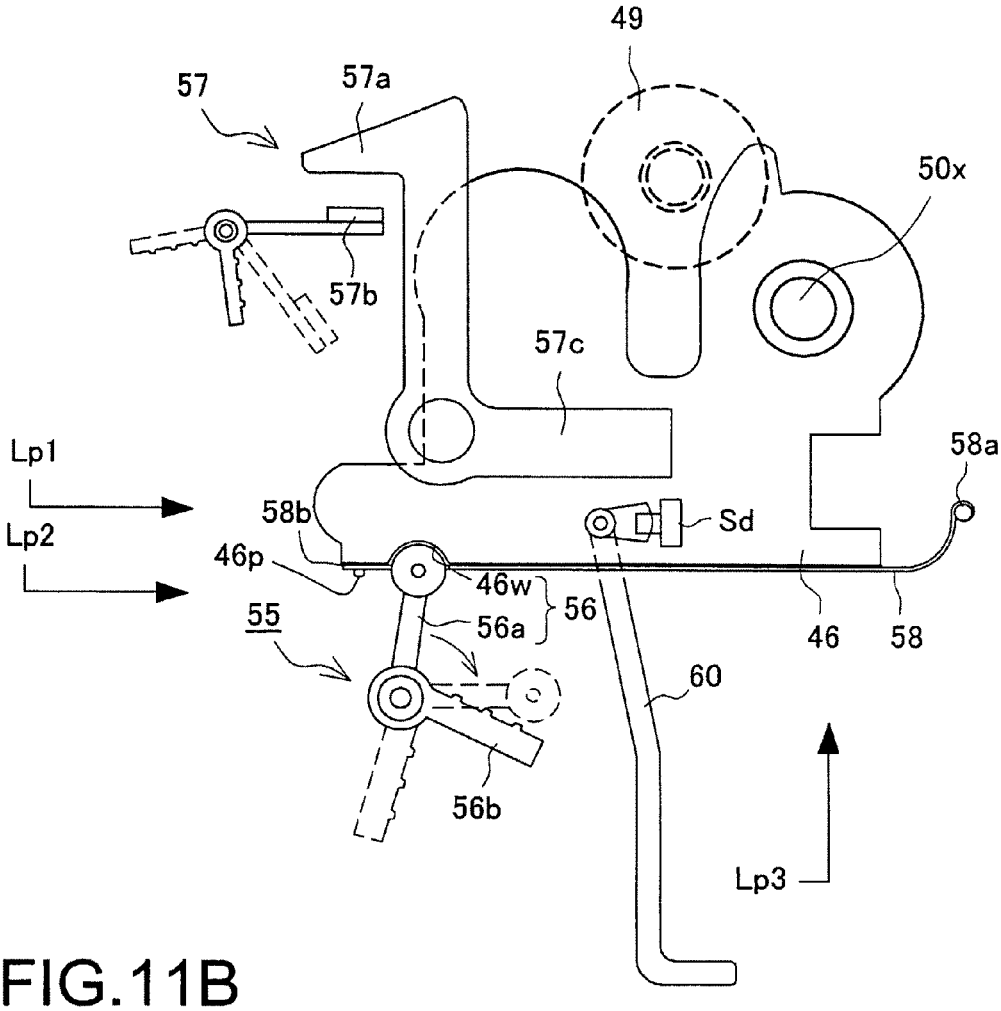
FIG. 11A is a configuration view of operating means.
Figure 11B:
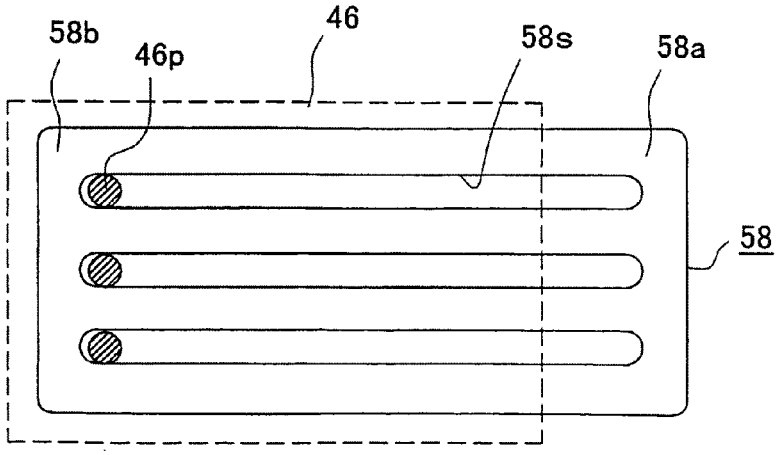
FIG. 11B is a detailed explanatory view of a cover member.

The engagement hook 57*a* disposed on the second bracket member side is provided with an operating lever (second operating lever) 57*c* for releasing latch engagement. When the operating lever 57*c* is operated to rotate in a clockwise direction in the state as shown in FIG. 11A, the temporary latch 57 is released, and the second bracket member 46 rotates freely on the rotary shaft 50*x*.

Thus, the second bracket member 46 takes attitudes in three stages of engagement position (real latch position) Lp1, first release position (temporary latch position) Lp2, and second release position (free state) Lp3. Then, in the real latch position Lp1, the first to fourth rollers 49, 41, 50, 64 are set for the state in which the rollers are brought into press-contact with one another. In the temporary latch position Lp2, the first to fourth rollers are set for a loose fit state. In the free state Lp3, the second bracket member 46 can be swung in free angular positions.

Meanwhile, when the second bracket member 46 shifts in position on the rotary shaft 50*x* as the center from the engagement position Lp1 to the second release position Lp3, the cam engagement portion 46*c* presses the interlocked engagement portion 45*z* of the first bracket member 45. Then, the first bracket member 45 is interlocked in the clockwise direction in FIG. 8A on the spindle 45*r*, and swings the bracket member 45 in the separation direction. By this swing, the first roller 49 separates from the second and third rollers 41, 50, and the engagement of the press-contact portions Np1, Np2 is released.

For the folding processing section 48, in the casing 29 are disposed the sheet transport path (first transport path) 32, folding roller means 49, 41, 50, 64, and storage stocker 65 in this order from the top to the bottom. Then, the first roller 49, second roller 41, third roller 50 and fourth roller 64 for folding enhancement constituting the folding roller means are disposed above the storage stocker 65.

Accordingly, when an operator pulls sheets out of the stacker 65, there is a fear that the operator touches the roller press-contact portion. At the same time, when a sheet jam occurs in the roller press-contact portion, it is necessary to release the press-contact portion. Therefore, the second bracket member 46 is provided with a cover member 58 as described below.

[Configuration of the Cover Member]

Figure 10:
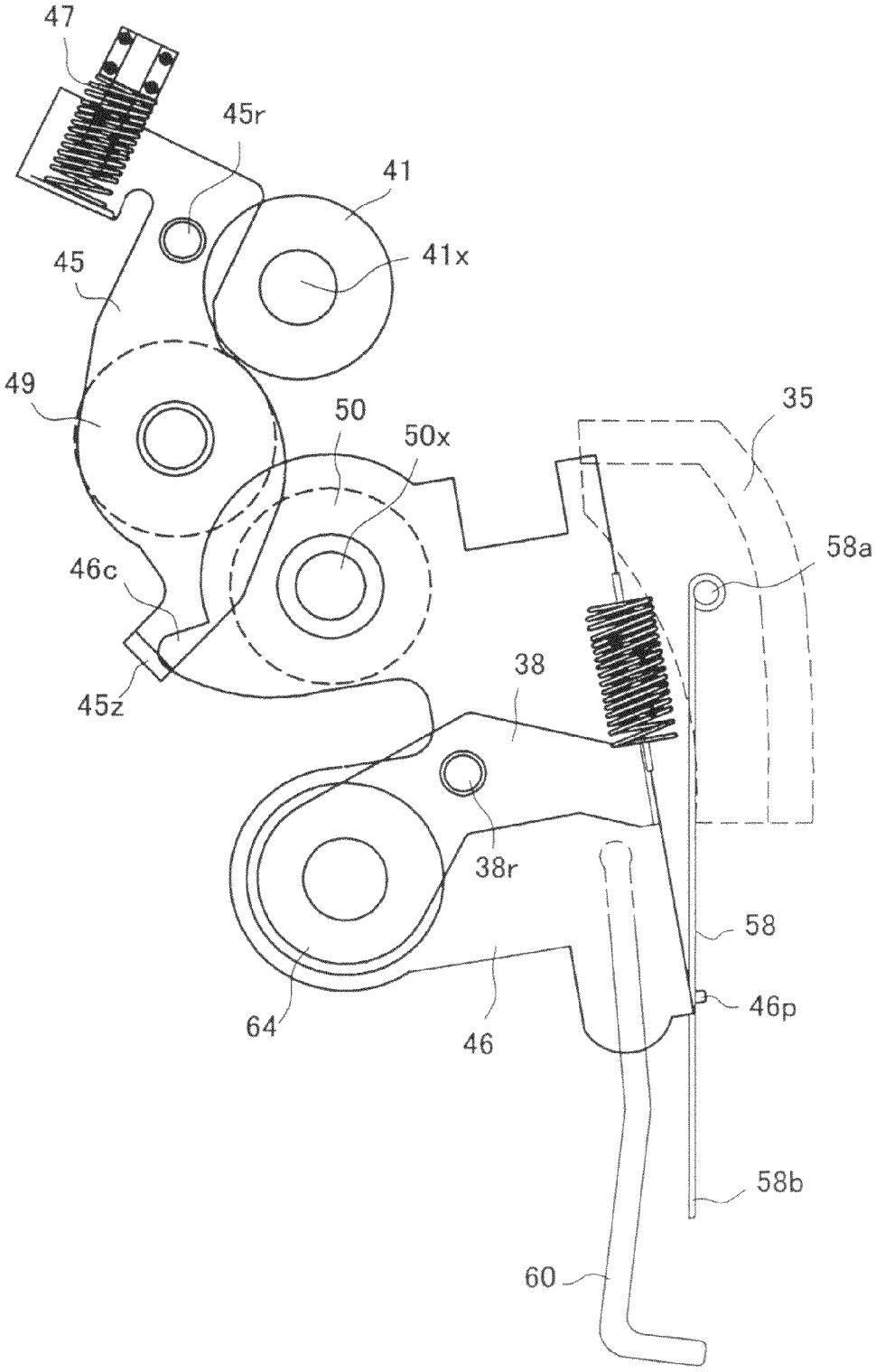
FIG. 10 is an explanatory view of a release state in the folding processing section.

The cover member 58 is to prevent the hand of an operator from being caught in the folding rollers when a jam occurs, and is attached in between the second switchback path 35 and the second bracket member 46. The cover member 58 is comprised of a resin film member having flexibility, and its base end portion 58*a* is fixed to a guide member of the second switchback path 35 (see FIG. 10), while its front end portion 58*b* is engaged and supported at slits 58*s* by pins 46*p* provided in the second bracket member 46.

Then, a pair of second bracket members 46 are disposed at the opposite end portions in the shaft direction of the folding roller to be opposed to each other, and the cover member 58 is attached in between the pair of bracket members.

Accordingly, the cover member 58 covers the storage stocker 65 and the roller press-contact portions Np2, Np3 positioned below when the second bracket member 46 is in the operating state. Meanwhile, when the second bracket member 46 is opened, it is configured that the operator is able to approach the roller press-contact portion from the storage stacker 65.

[Configuration of a Full Detecting Sensor]

Further, in the second bracket member 46 is disposed a full detection lever 60 that detects an uppermost sheet of the storage stacker 65. When the operator opens the second bracket member 46 to handle a jam, there is a fear that the detection lever is broken. Therefore, by integrally opening the detection lever 60 and second bracket member 46, it is intended that the detection lever 60 withdraws from the work area of the jam handling. Sd shown in the figure denotes a sensor that detects the detection lever 60.

[Driving Mechanism]

Figure 12:
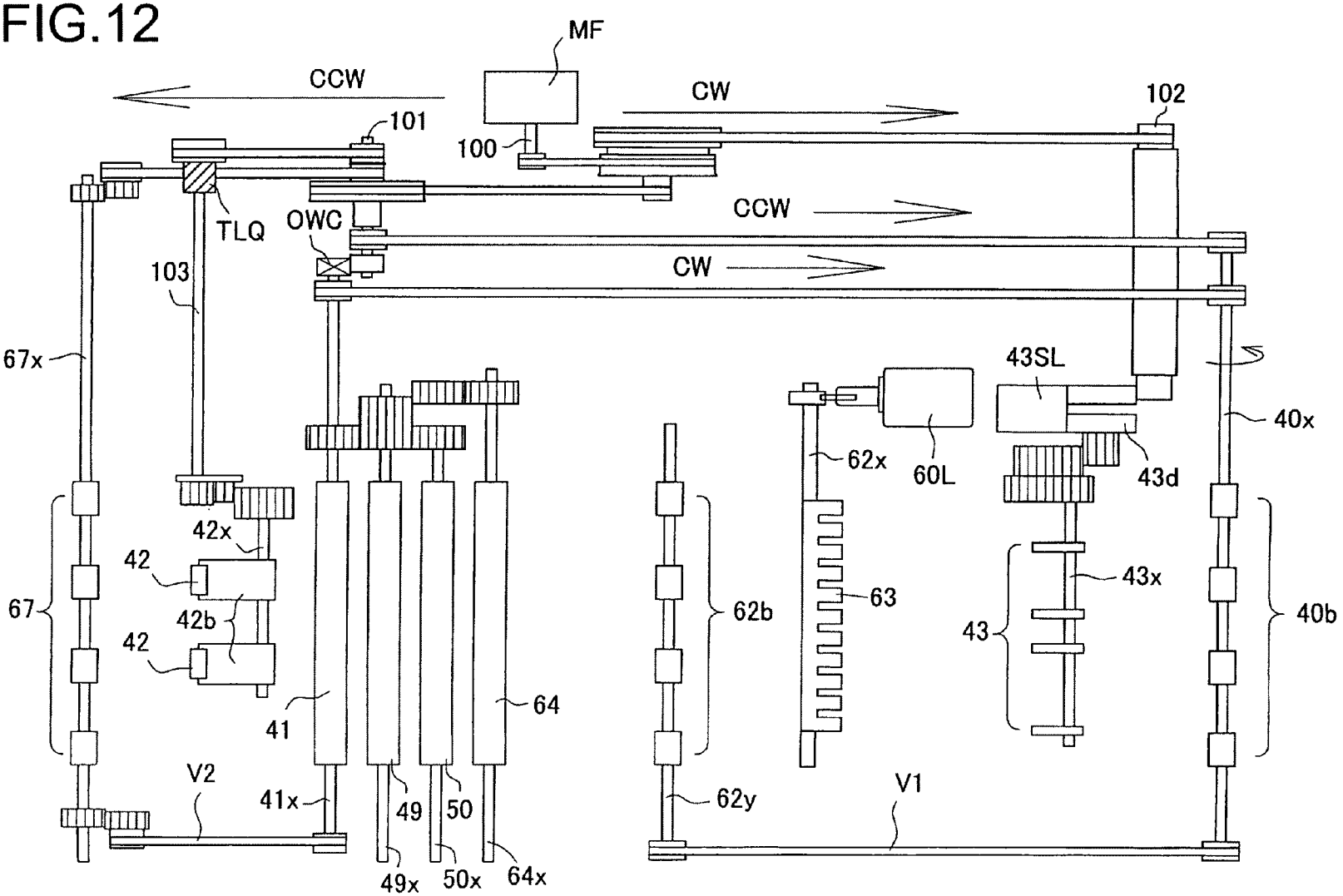
FIG. 12 is an explanatory view of a driving mechanism according to sheet transport in the apparatus of FIG. 3.
Figure 13A:
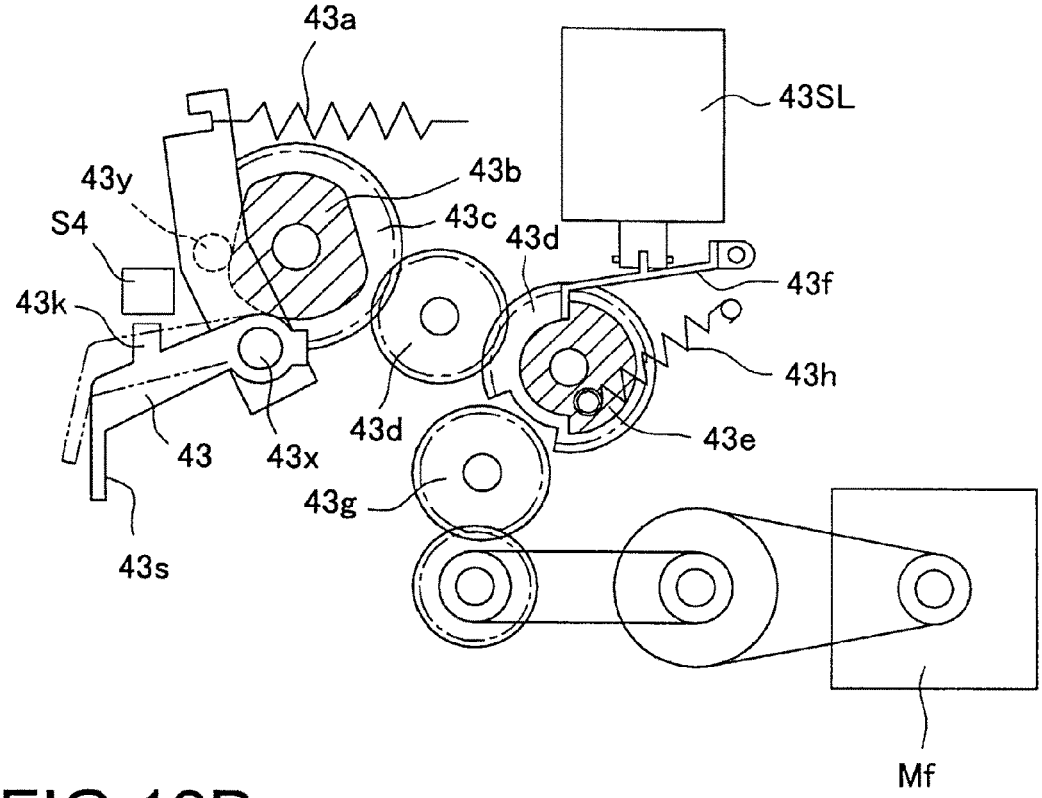
FIG. 13A and FIG. 13B contain explanatory views of a sheet carry-in mechanism in the apparatus of FIG. 3, where
Figure 13B:
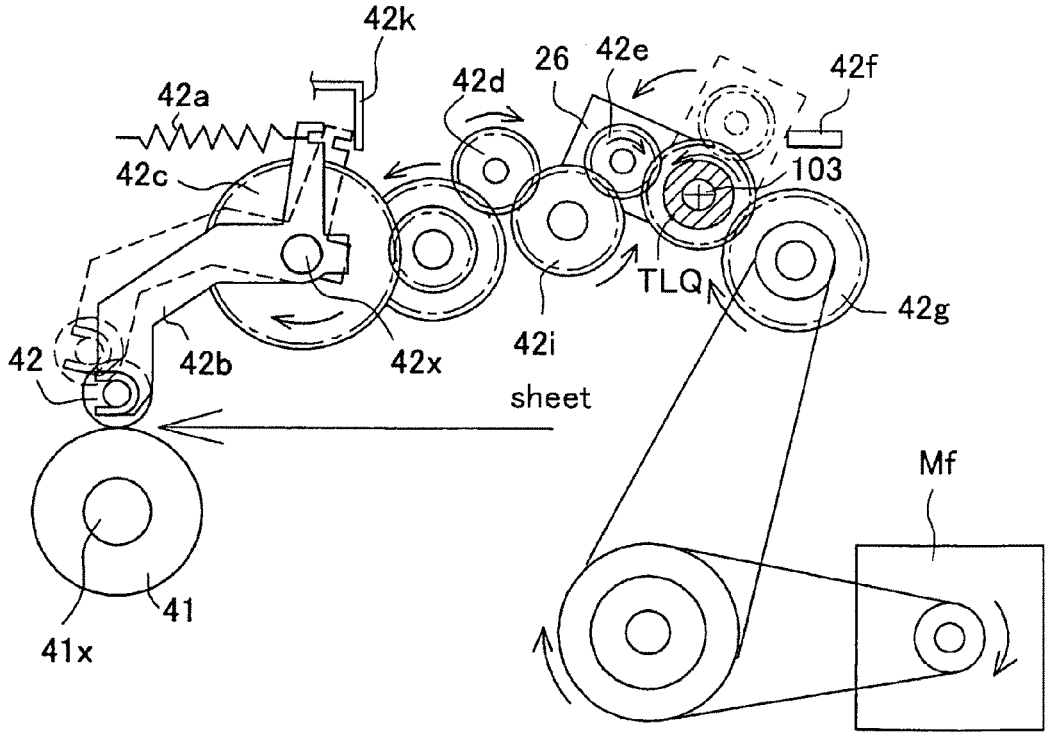

The driving mechanism of the apparatus as shown in FIG. 3 will be described below according to FIGS. 12 and 13. FIG. 12 shows the driving transfer system of the feeding motor Mf, FIG. 13A shows the state in which the gate stopper 43 is operated by the feeding motor Mf, and FIG. 13B shows the state in which the pinch roller 42 is operated by the feeding motor Mf.

In FIG. 12, a motor rotary shaft 100 of the feeding motor Mf conveys rotation in the forward direction (CW) and rotation in the backward direction to the rotary shaft 40*x* of the carry-in roller 40*b* via an intermediate shaft 101. The rotary shaft 40*x* conveys to the rotary shaft 62*y* of the carrying-out roller 62*b* via a transmission belt V1.

By this means, the forward and backward rotation of the feeding motor Mf is conveyed to the carry-in roller pair 40*a*, 40*b* and carrying-out roller pair 62*a*, 62*b* as rotation in the sheet discharge direction. CW shown in the figure denotes a transmission system of rotation in the forward direction, and CCW denotes a transmission system of rotation in the backward direction. By gear transfer, the rotation directions of the carry-in roller pair 40*a*, 40*b* and the carrying-out roller pair 62*a*, 62*b* are set at one direction.

Further, the rotary shaft 100 of the feeding motor Mf conveys the rotation in the forward direction to the spindle 43*x* of the gate stopper 43 via an intermediate shaft 102, while conveying the rotation to the spindle 42*x* of the pinch roller 42 via an intermediate shaft 103. The transmission system is to shift in position the gate stopper 43 and the pinch roller 42 to the waiting position by the rotation in the forward direction (CW) of the feeding motor Mf, and will be described later including the clutch mechanism.

In rotation of the intermediate shaft 101, the rotation in the forward direction (CW) is only conveyed to the folding rollers via a one-way clutch OWC. As shown in FIG. 12, the rotation in the forward direction of the intermediate shaft 101 is transferred to the first roller 49, second roller 41, third roller 50 and folding enhancement roller 64 by gears. In addition, the folding enhancement roller 64 is a roller in press-contact with the first roller 49 (described later). Further, the rotation in the forward direction (CW) and the rotation in the backward direction (CCW) of the feeding motor Mf are conveyed to the rotary shaft 67*x* of the sheet discharge roller 67.

[Driving Mechanism of the Gate Stopper and Pinch Roller]

Driving of the gate stopper 43 and pinch roller 42 as shown in FIG. 13A and FIG. 13B will be described next. FIG. 13A shows the driving mechanism of the gate stopper 43, the gate stopper 43 swings on the spindle 43*x*, and a lock surface 43*s* at the front end shifts to positions between a lock position positioned in the first transport path 32 and a waiting position outside the path.

Therefore, the gate stopper 43 is always biased in the direction of an eccentric cam 43*b* by a spring 43*a*, and shifts in position to the lock position (solid line in FIG. 13A) and the waiting position (dashed line in FIG. 13A) by the eccentric cam 43*b*. Therefore, a cam follower 43*y* is formed at one end of the gate stopper 43, and engages in the eccentric cam 43*b*. Then, in the eccentric cam 43*b*, a cam gear 43*c* rotating integrally with the cam 43*b* is coupled to a teeth-lacked gear 43*d* by gear. A transmission gear 43*g* of the feeding motor Mf is mated with the teeth-lacked gear 43*d*. The teeth-lacked gear 43*d* and the transmission gear 43*g* mesh with each other so as not to convey driving in the teeth lacking portion. Then, the teeth-lacked gear 43*d* is integrally coupled to a control cam 43*e*.

In the control cam 43*e* are engaged a biasing spring 43*h* and actuation solenoid 43SL, the biasing spring 43*h* biases the teeth-lacked gear 43*d* in the transmission direction, and the actuation solenoid 43SL is engaged to lock the control cam 43*e* to the non-transmission state by a lock hook 43*f*. Accordingly, rotation of the feeding motor Mf is transferred to the teeth-lacked gear 43*d* by the transmission gear 43*g*, and the eccentric cam 43*b* rotates by the rotation. Then, the actuation solenoid 43SL is coupled to lock the transmission gear 43*g* and teeth-lacked gear 43*d* to the non-transmission state in the non-energized state, while conveying the rotation of the transmission gear 43*g* to the teeth-lacked gear 43*d* in the energized state.

In addition, in the eccentric cam 43*b* and the teeth-lacked gear 43*d*, the gear coupling rate is set so that a single rotation of the teeth-lacked gear 43*d* rotates the eccentric cam 43*b* half rotation (½ rotation). Then, the gate stopper 43 swinging up and down by the eccentric cam 43*b* is provided with a flag 43*k* and position sensor S4 (see FIG. 13A). Accordingly, the control cam 43*e* integrally formed in the teeth-lacked gear 43*d* shifts the gate stopper 43 to positions between the actuation position and the withdrawal position by two rotations.

Then, when the actuation solenoid 43SL is controlled from the ON state to the OFF state after the teeth-lacked gear 43*d* rotates once, the gate stopper 43 is positioned in the withdrawal position, and rests in the position. Further, when the actuation solenoid 43SL is controlled from the ON state to the OFF state after the teeth-lacked gear 43*d* rotates twice, the gate stopper 43 shifts from the actuation position to the withdrawal position by first one rotation, and returns from the withdrawal position to the actuation position by next one rotation. The position sensor S4 is an abnormality detecting sensor that detects a state in which the gate stopper 43 is in the withdrawal position.

In such a configuration, the feeding motor Mf conveys the rotation of the motor to the eccentric cam 43*b* in the forward rotation. In the backward-direction rotation, the actuation solenoid 43SL is maintained at the non-energized state (OFF state), and driving is not conveyed in the teeth lacking portion of the teeth-lacked gear 43*d*.

The driving mechanism of the pinch roller 42 shown in FIG. 13B will be described next. As described previously, the pinch roller 42 is attached to an arm 42*b* (roller shift means; the same in the following), and the bracket 42*b* is configured to swing on the spindle 42*x* as the center. Therefore, the pinch roller 42 is kept always at the actuation position (solid line in FIG. 13B) by the biasing spring 42*a*. A transmission gear 42*c* is coupled to the shaft portion of the arm 42*b* to rotate integrally, and a clutch gear 42*e* meshes with the transmission gear 42*c* via a transmission gear line 42*d*. A transmission gear 42*g* of the feeding motor Mf is coupled to the clutch gear 42*e* via a torque limiter TLQ.

The clutch gear 42*e* is supported by a planetary lever 26 swinging on the intermediate shaft 103 as described previously as the center, and the spindle of the planetary lever is provided with the torque limiter TLQ. "42*f*" shown in the figure denotes a stopper for locking the clutch gear 42*e* to the non-transmission state. When the transmission gear 42*g* rotates by backward-direction rotation of the feeding motor Mf in the state of FIG. 13B, the planetary lever 42*h* swings in a clockwise direction, and the clutch gear 42*e* attached to the lever 26 meshes with the transmission gear line 42*d* and conveys rotation of the transmission gear 42*g* to the transmission gear 42*c*.

Then, the arm 42*b* integrated with the transmission gear 42*c* shifts to the withdrawal position as the dashed-line state in FIG. 13B. Subsequently, the arm 42*b* engages in a stopper 42*k* and is locked in the position. At this point, the transmission gear line 42*d* and the clutch gear 42*e* idle by the torque limiter TLQ, are halted in rotation, and are locked in the state.

Then, when the feeding motor Mf rotates in the forward direction, the transmission gear 42*g* rotates in a clockwise direction, and the planetary lever 26 gear-coupled to the gear 42*g* rotates in a counterclockwise direction. In this state, the coupling between the clutch gear 42*e* and the transmission gear line 42*d* is released, and the clutch gear 42*e* and the transmission gear line 42*d* are locked in the state by the torque limiter TLQ.

Accordingly, in the forward-direction rotation of the feeding motor Mf, the rotation of the transmission gear 42*g* is not conveyed to the transmission gear 42*c* of the arm 42*b*, and the pinch roller 42 is maintained at the state (the actuation position; solid line in FIG. 13B) in press-contact with the second roller 41 in the first transport path 32 by action of the biasing spring 42*a*.

Meanwhile, when the feeding motor Mf rotates in the backward direction, the transmission gear 42*g* rotates in a counterclockwise direction, the clutch gear 42*e* of the planetary lever 26 engages in the transmission gear line 42*d* by the rotation, and the pinch roller 42 shifts in position to the withdrawal position (dashed line in FIG. 13B) withdrawn from the first transport path 32 and is locked in the state.

[Open/Close Operation of the Upper Unit]

The unit configuration of the gate stopper 43 will be described according to FIG. 13A. The gate stopper 43, spindle 43*x* and biasing spring 43*a* are attached to the upper unit 29A, and to the lower unit 29B are attached the eccentric cam 43*b* for moving the gate stopper 43 up and down, the cam gear 43*c* for driving and rotating the cam, the teeth-lacked gear 43*d*, the transmission gear 43*g* and the feeding motor Mf for driving the cams and gears.

Then, in opening and closing the upper unit 29A around the hinge shaft 28, required is an engagement mechanism with the eccentric cam 43*b* on the lower unit 29B side. The open/close mechanism will be described later according to FIG. 15.

Similarly, the unit configuration of the pinch roller 42 will be described according to FIG. 13B. The pinch roller 42, arm 42*b*, spindle 42*x* of the arm, and biasing spring 42*a* are attached to the upper unit 29A, and concurrently, the gear 42*c* provided in the spindle 42*x* and the transmission gear line 42*d* of the gear are also attached to the upper unit 29A. Meanwhile, to the lower unit 29B are attached the clutch gear 42*e* meshing with the transmission gear line 42*d*, planetary lever 26, torque limiter TLQ, transmission gear 42*g* and feeding motor Mf for driving them.

Then, in opening and closing the upper unit 29A around the hinge shaft 28, required is the engagement mechanism for the transmission gear line 42*d* attached to the upper unit 29A and the clutch gear 42*e* attached on the lower unit 29B side. The open/close mechanism will be described later according to FIG. 15.

Figure 15:
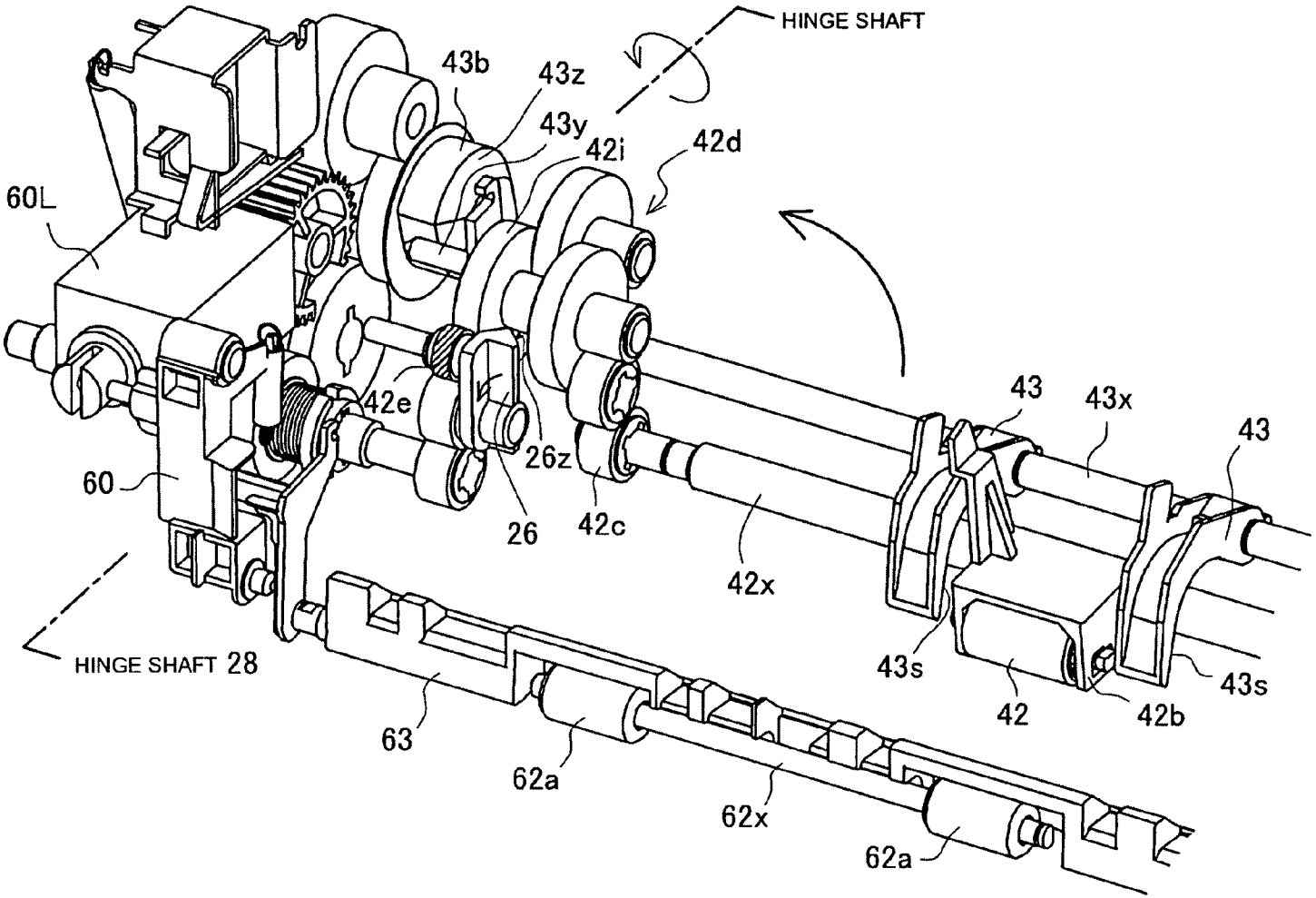
FIG. 15 is an explanatory view of a driving system in the apparatus of FIG. 3, and shows a closed state of the upper unit.
Figure 16:
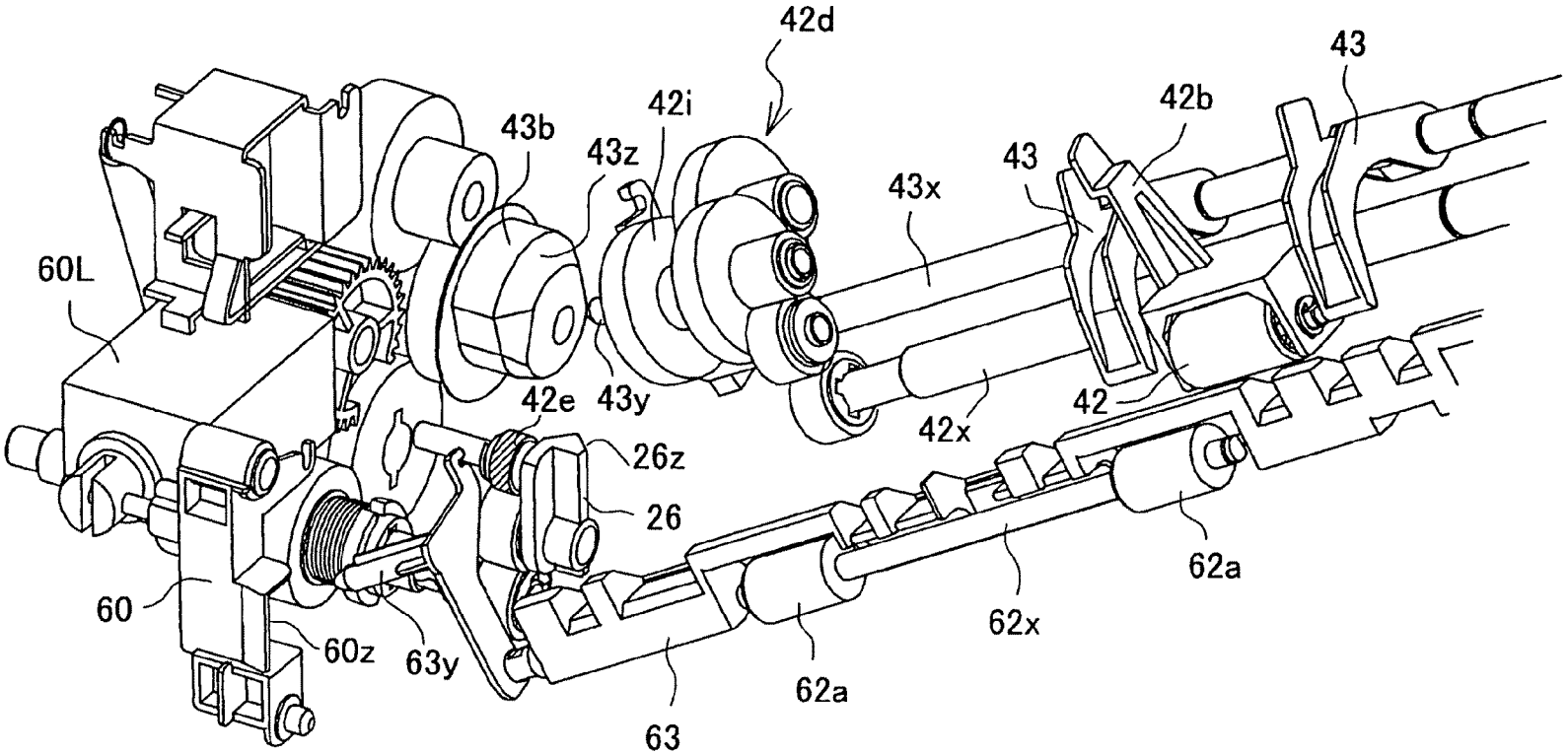
FIG. 16 is another explanatory view of the driving system in the apparatus of FIG. 3, and shows an open state of the upper unit.
Figure 17:
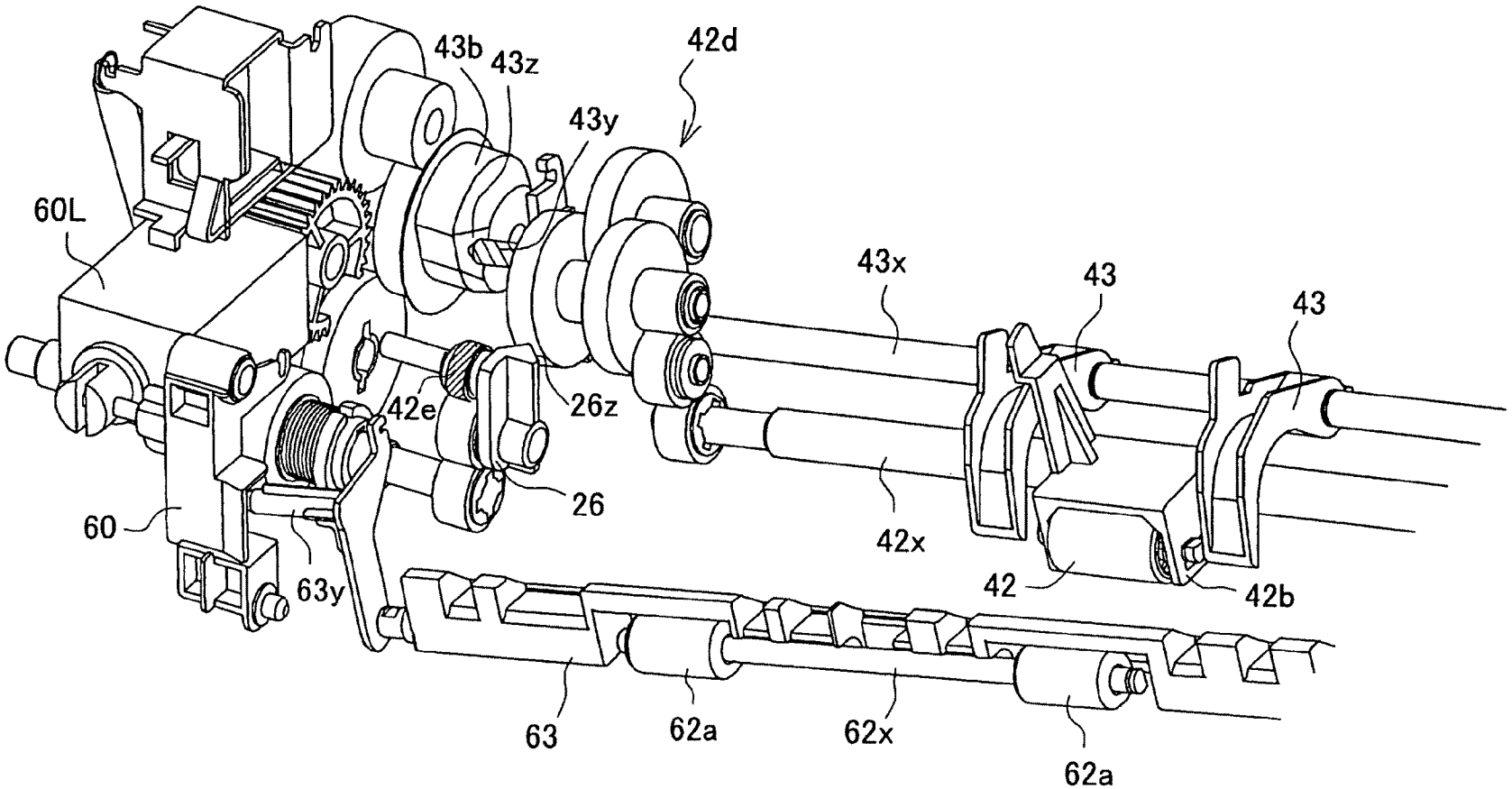
FIG. 17 is an explanatory view of the driving system in the apparatus of FIG. 2, and shows a semi-open state of the upper unit.

FIGS. 15 to 17 are explanatory views of open/close operation of the upper unit 29A. FIG. 15 shows the operating state in which the upper unit 29A is closed, FIG. 16 shows an open state in which the upper unit 29A is opened by a predetermined angle θ, and FIG. 17 shows an intermediate state in opening/closing the upper unit 29A.

FIG. 15 shows the unit closed state, and the cam follower 43*y* and eccentric cam 43*b* of the gate stopper 43 are engaged with each other so as to move the gate stopper 43 up and down by rotation of the cam. Further, the gear 42*c* for moving the pinch roller 43 up and down, and the transmission gear line 42*d* of the gear mesh with the clutch gear 42*e*. In this state, each of the gate stopper 43 and pinch roller 42 moves up and down by the driving force conveyed from the feeding motor Mf.

FIG. 16 shows the unit open state. The cam follower 43*y* of the gate stopper 43 and the actuation lever 63*y* of the path switching means 63 are hinge-rotated the predetermined angle θ, and in this state, the cam follower 43*y* is in a position separate from the eccentric cam 43*b*, while the actuation lever 63*y* is in a position separate from the link lever 60 (engagement release state). Further, the pinch roller 42 and the transmission gear line 42*d* for moving the roller up and down are hinge-rotated the predetermined angle θ, and in this state, the transmission gear line 42*d* is in a position separate from the clutch gear 42*e* (engagement release state).

Then, as shown in FIG. 15, in the eccentric cam 43*b* that engages in the cam follower 43*y* is formed a guide surface 43*z* for guiding the cam follower 43*y* to the cam surface. The guide surface 43*z* is formed in the shape of a cone with a slope for guiding the cam follower 43*y* to the cam surface during the process of shifting (close operation) to the closed state (the state in FIG. 15) from the state in which the cam follower 43*y* engages in the guide surface 43*z* in the semi-open state of the upper unit 29A as shown in FIG. 17.

In other words, in the eccentric cam 43*b* is formed the guide surface 43*z* for guiding the cam follower 43*y* to the cam surface, and the guide surface 43*z* is formed to guide the cam follower 43*y* to the cam surface when the upper unit 29A swings and moves around the hinge shaft 28.

Similarly, as shown in FIG. 14, in the link lever 60 that engages in the actuation lever 63*y* is formed a guide surface 60*z* in the shape of a cone for guiding the actuation lever 63*y* to the engagement surface, and the guide surface 60*z* is formed to guide the actuation lever 63*y* to the engagement surface when the upper unit 29A swings and moves around the hinge shaft 28.

Further, the clutch gear 42*e* for moving the pinch roller 42 up and down is attached to the planetary lever 26 as described previously, and the lever 26 swings on the rotary shaft 103 from the solid-line state to the dashed-line state in FIG. 13B. In such a configuration, as shown in FIG. 15, the planetary lever 26 is provided in the rotary shaft 103 attached to the lower unit 29B. The planetary lever 26 is provided with a sloped cam surface 26*z* that engages in a cam gear 42*i* attached to the upper unit 29A.

Then, in opening and closing the upper unit 29A around the hinge shaft 28, the clutch gear 42*e* and the planetary lever 26 attached to the gear are shifted from the solid-line state to the dashed-line state in FIG. 13B.

In other words, by the open/close operation of the upper unit 29A, the clutch gear 42*e* attached to the lower unit 29B is shifted from the transmission state to non-transmission state. By this means, the transmission gear 42*d* provided in the upper unit 29A and the clutch gear 42*e* are engaged and released. Accordingly, when the sloped cam surface 26*z* of the planetary lever 26 is disposed in a position for engaging in the cam gear 42*i* of the upper unit A, the cam gear 42*i* constitutes an interlock member for actuating the planetary lever 26. Alternately, other than the cam gear 42*i*, an interlock member (cam actuator) may be provided in any component of the upper unit A or particularly in the upper unit A, and be configured to engage in the sloped cam surface 26*z*.

Thus, the transport control means such as the gate stopper 43 and pinch roller 42 in the upper unit 29A are coupled to the feeding motor Mf disposed in the lower unit 29B by the transmission mechanism, engagement/release of the transmission mechanism is interlocked with the open/close operation of the upper unit 29A, the motor is thereby shared as the driving motor of the folding roller pair of the lower unit 29B, and it is thus possible to simplify the driving mechanism.

[Driving Mechanism of the Shift Motor]

Figure 18A:
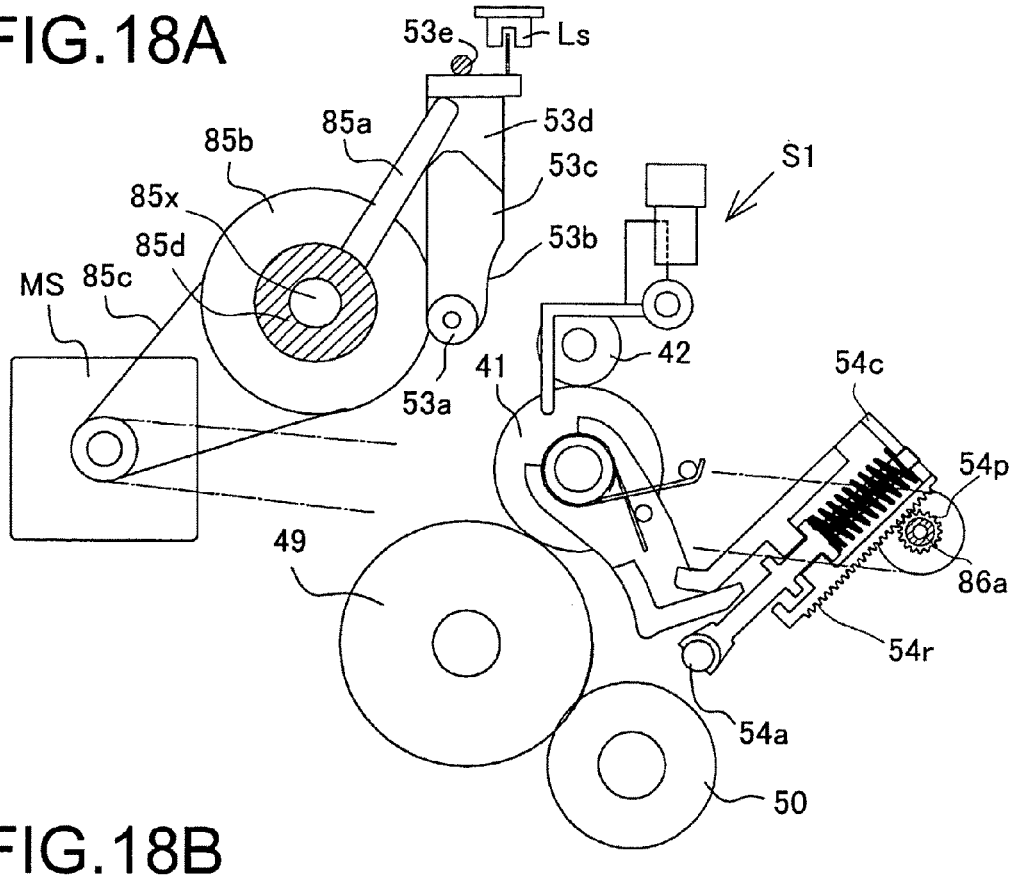
FIG. 18A and FIG. 18B contain explanatory views of a driving mechanism of first folding deflecting means and second folding deflecting means in the apparatus of FIG. 3, where
Figure 18B:
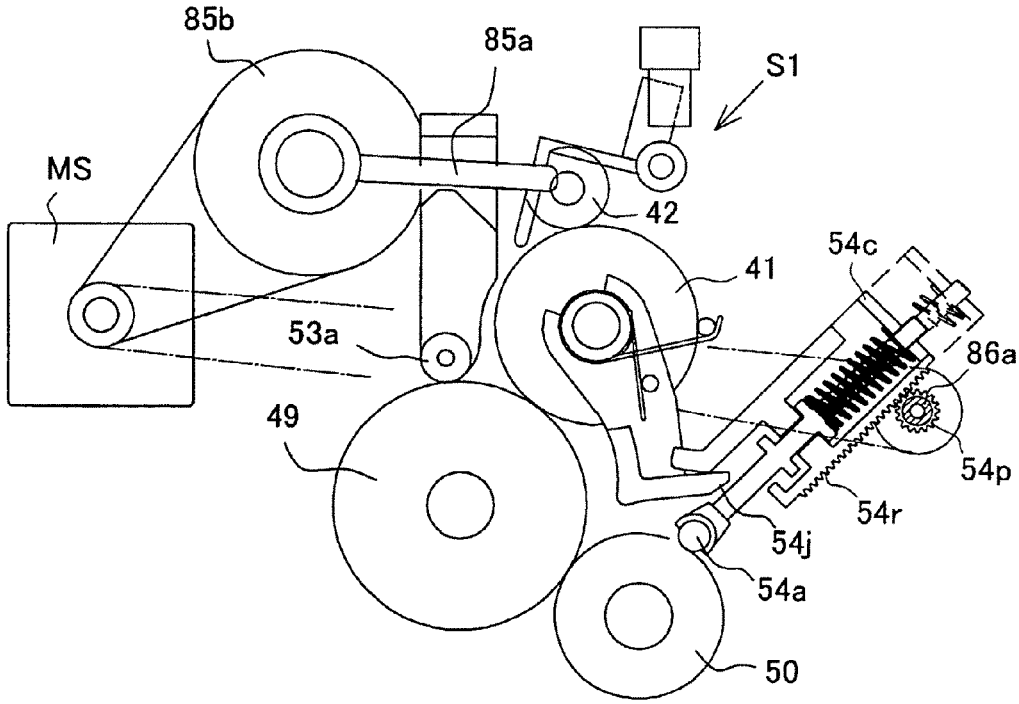

Described next is the driving mechanism of the first folding deflecting means 53 and the second folding deflecting means 54 as described previously. As shown in FIG. 18A and FIG. 18B, in the first folding deflecting means 53, the driven roller 53*a* and the curved guide 53*b* are supported by the up-and-down member 53*c* moving up and down in a predetermined stroke. The up-and-down member 53*c* is provided with an actuation lever 85*a* swingable on a spindle 85*x* as the center to engage in the member 53*c*. In other words, in the up-and-down member 53*c* supported by the apparatus frame in a guide rail (not shown) to be able to move up and down, a cam groove 53*d* is provided, and is disposed so that the front end of the actuation lever 85*a* engages in the cam groove 53*d*.

Then, the actuation lever 85*a* is coupled to the spindle 85*x* via a spring clutch 85*d*. Concurrently therewith, the spindle 85*x* is provided with a pulley 85*b*, and rotation of the shift motor MS is conveyed to the pulley 85*b* via a transmission belt 85*c*. Then, the spring clutch 85*d* is set to convey the rotation of the shift motor MS from the spindle 85*x* to the actuation lever 85*a*. Concurrently therewith, when the load of predetermined torque or more is imposed, the spring clutch 85*d* idles with respect to the spindle 85*x*, and is configured not to convey the rotation of the shift motor MS to the actuation lever 85*a*.

Accordingly, when the shift motor MS rotates in the forward direction, the actuation lever 85*a* rotates from the state of FIG. 18A to the state of FIG. 18B in a clockwise direction shown in the figure, and after the driven roller 53*a* comes into contact with the periphery of the first roller 49, the spring clutch 85*d* idles. Then, when the shift motor MS rotates in the backward direction, the actuation lever 85*a* rises from the state of FIG. 18B to the state of FIG. 18A. After the up-and-down member 53*c* strikes the stopper 53*e*, the spring clutch 85*d* idles and the state is locked as shown in the figure. In addition, a limit sensor Ls is disposed in the this position, and the rotation of the shift motor MS is halted by a state signal such that the up-and-down member 53*c* shifts to a predetermined stopper position.

Meanwhile, in the second folding deflecting means 54, similarly, the up-and-down member 54*c* is supported by the apparatus frame to move up and down in a predetermined stroke, and is provided with the driven roller 54*a* and curved guide 54*b*. As described previously, the up-and-down member 54*c* is provided with a rack 54*r* that meshes with a pinion 54*p*. Then, the shift motor MS is coupled to the pinion 54*p* via a spring clutch 86*a*. The spring clutch 86*a* is set to convey the rotation of the shift motor MS within predetermined torque, while idling at the predetermined torque or more.

In addition, in the first folding deflecting means 53 and the second folding deflecting means 54, the up-and-down member 53*c* shifts in position from the withdrawal position to the actuation position by the forward-direction rotation of the shift motor MS, and by the rotation in this direction, the up-and-down member 54*c* of the second folding deflecting means shifts in position from the actuation position to the withdrawal position. Alternately, in the backward-direction rotation of the shift motor MS, the up-and-down member 54*c* of the second folding deflecting means 54 shifts in position from the withdrawal position to the actuation position, and by the rotation in this direction, the up-and-down member 53*c* of the first folding deflecting means 53 shifts in position from the actuation position to the withdrawal position. Thus, the first folding deflecting means 53 and second folding deflecting means 54 are configured to shift to positions between the actuation position and the withdrawal position in a relatively opposite manner by forward and backward rotation of the shift motor MS.

[Sheet Front End Detecting Sensor]

As shown in FIG. 3, a first sensor S1 for detecting an end edge of a sheet is disposed in the first transport path 32, and detects the end edge (front end and rear end) of the sheet carried in the first switchback path 34. Further disposed is a second sensor S2 for detecting the end edge of the sheet carried in the second switchback path 35. The first sensor S1 and second sensor S2 detect the end edge of the sheet to calculate the fold position of the sheet, and the action of the sensors will be described later together with folding forms described later.

[Folding Processing Form]

Figure 22A:
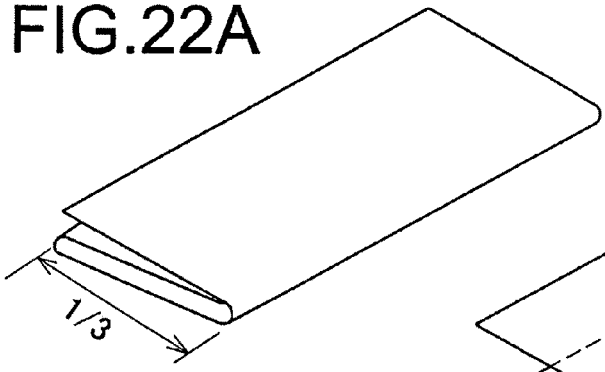
FIG. 22A, FIG. 22B, FIG. 22C, FIG. 22D and FIG. 22E contain explanatory views of sheet folding forms in the sheet folding apparatus of the invention, where
Figure 22D:
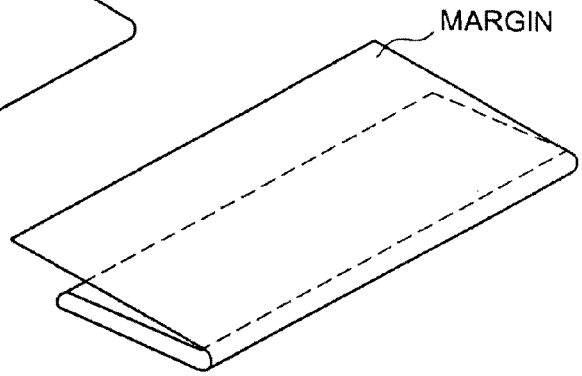
Figure 22B:
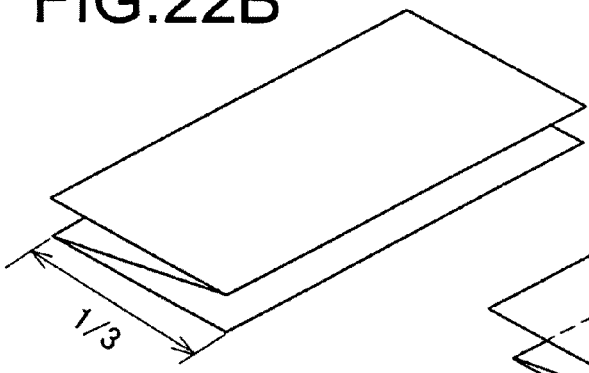
Figure 22E:
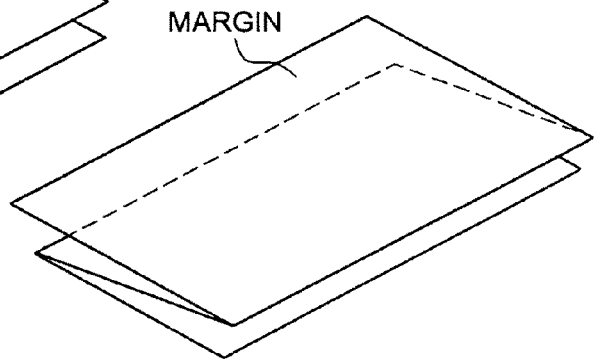
Figure 22C:
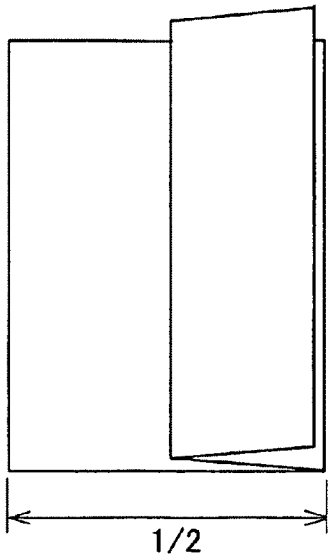

A sheet folding method by the above-mentioned folding processing means will be described next according to FIG. 22A, FIG. 22B, FIG. 22C, FIG. 22D and FIG. 22E. In a normal sheet with the image formed, there are cases that the sheet is folded in two or three for a letter finish. Further, in folding in three, there are cases of outward three-folding and inward three-folding. FIG. 22A shows an aspect of inward three-folding, FIG. 22B shows an aspect of outward three-folding, and FIG. 22C shows an aspect of Z-folding.

Then, in the case of two-folding, the sheet fed to the second transport path 33 is folded in a ½ position of the sheet size or in a ½ position with a margin left in the sheet end portion by the first and second rollers 49, 41 (first folding).

Meanwhile, in the case of three-folding, the sheet fed to the second transport path 33 is folded in a ⅓ position of the sheet size by the first and second rollers 49, 41 (first folding). The first and third rollers 49, 50 fold the remaining sheet in a ⅓ position of the folded sheet (second folding) to feed to the third transport path 36.

Further, in the case of three-folding, when inward three-folding is performed as shown in FIG. 22A, the sheet fed to the second transport path 33 is folded in a ⅓ position on the sheet rear end side by the first and second rollers 49, 41 and next, is folded in a ⅓ position on the sheet front end side. Similarly, in the case of outward three-folding, the sheet fed to the second transport path 33 is folded in a ⅓ position on the sheet front end side by the first and second rollers 49, 41 and next, is folded in a ⅓ position on the sheet rear end side.

Furthermore, in the case of three-folding, when Z-folding as shown in FIG. 22C is performed, the sheet fed to the second transport path 33 is folded in a ¼ position on the sheet rear end side by the first and second rollers 49, 41 and next, is folded in a ½ position of the sheet.

Moreover, there is the case that the fold width of three-folding is widened according to the envelop size to leave the margin. In the case of performing inward three-folding as shown in FIG. 22D, the sheet is folded in a position slightly closer to the rear end side than the ⅓ position of the sheet size (first folding), and next, is folded in a position of the substantially same width as the width of the first-folded sheet on the sheet front end side (second folding). Similarly, in outward three-folding as shown in FIG. 22E, the sheet is folded in a position slightly closer to the front end side than the ⅓ position on the sheet front end side, and next, is folded in a position of the substantially same width as the width of the first-folded sheet on the sheet rear end side (second folding). In other words, in the case of leaving the margin in the three-folded sheet, the sheet is folded so that the side of the second-folded sheet is long.

[Control Means]

The control means 95 for above-mentioned sheet folding is configured as described below. The sheet folding apparatus B as described previously is mounted with a control CPU, or a control section 91 of the image formation apparatus A is provided with a folding processing control section. Then, the control section is configured to enable the following operation.

First, the first switchback path 34 and second switchback path 35 of the second transport path 33 are provided with stopper means (not shown) for regulating the position of the sheet front end or sensor means (S1 and S2 shown in the figure) for detecting the position of the sheet front end. In the apparatus as shown in the figure, the first sensor S1 is disposed in the first switchback path 34, and the second sensor S2 is disposed in the second switchback path 35. Then, the control means 95 is configured to calculate timing at which the fold position of the sheet arrives at a predetermined position from the sheet size information sent from the image formation apparatus A and a detection signal from the sensor S1 (S2).

Figure 23:
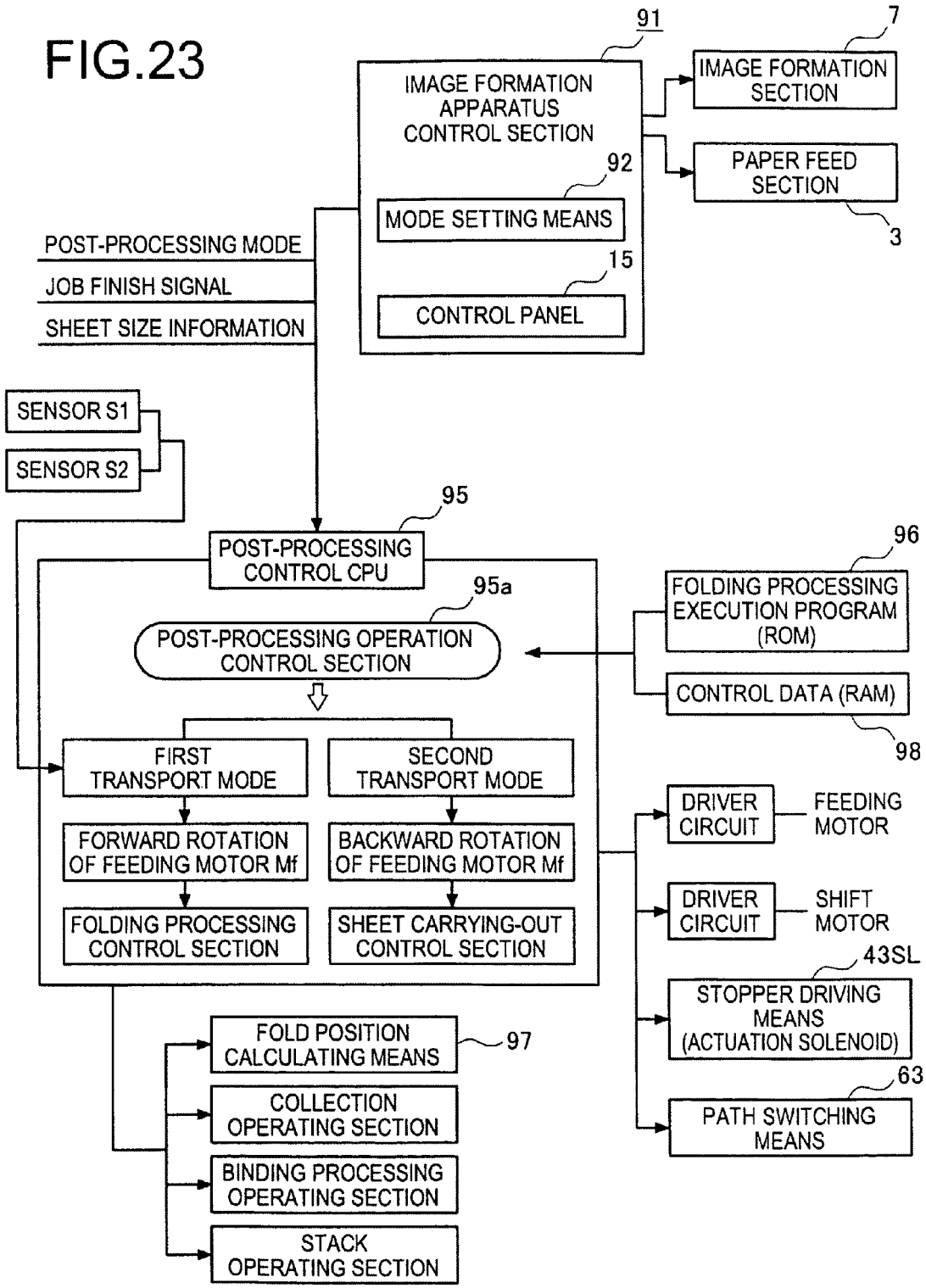
FIG. 23 is an explanatory view of a control configuration in the system of FIG. 1.

Then, the operation will be described according to the control block diagram shown in FIG. 23. In the image formation apparatus A, a control CPU 91 is provided with a control panel 15 and mode setting means 92. The control CPU 91 controls a paper feed section 3 and image formation section 7, corresponding to image formation conditions set in the control panel 15. Then, the control CPU 91 transfers data and commands such as "post-processing mode", "job finish signal" and "sheet size information" required for post-processing to the control section 95 of the post-processing apparatus C.

The control section 95 of the post-processing apparatus C is a control CPU, and is provided with a post-processing operation control section 95*a*. Then, detection signals of the first sensor S1 and second sensor S2 are conveyed to the control CPU 95. Meanwhile, the control CPU 95 conveys "ON"/"OFF" control signals to the stopper driving means (solenoid 43SL) provided in the gate stopper means 43 and the path switching means 63.

Then, for the control CPU 95, folding processing execution programs are stored in ROM 96 to control the feeding motor Mf (not shown), shift motor MS, stopper driving means (solenoid 43SL) and path switching means 63 so as to execute the folding forms as described previously. Further, RAM 98 stores data to calculate the fold of the sheet in fold position calculating means 97, and actuation timing time of the shift motor Ms as data.

The fold position calculating means 97 is comprised of a computing circuit for calculating a fold position (dimension) from the sheet front end (front end in the sheet discharge direction), from the "sheet length size", "folding form" and "margin dimension". For example, in the two-folding mode, the sheet is folded in a ½ position in the sheet discharge direction, or a ½ position with a beforehand set margin left. For example, calculation of the fold position is obtained by calculating [{(sheet length size)−(margin)}/2]. Further, in the three-folding mode, for example, the fold position is calculated corresponding to the folding form such as letter folding (inward three-folding, outward three-folding) and filing folding (Z-folding, outward three-folding).

[Folding Processing Operation]

Figure 19A:
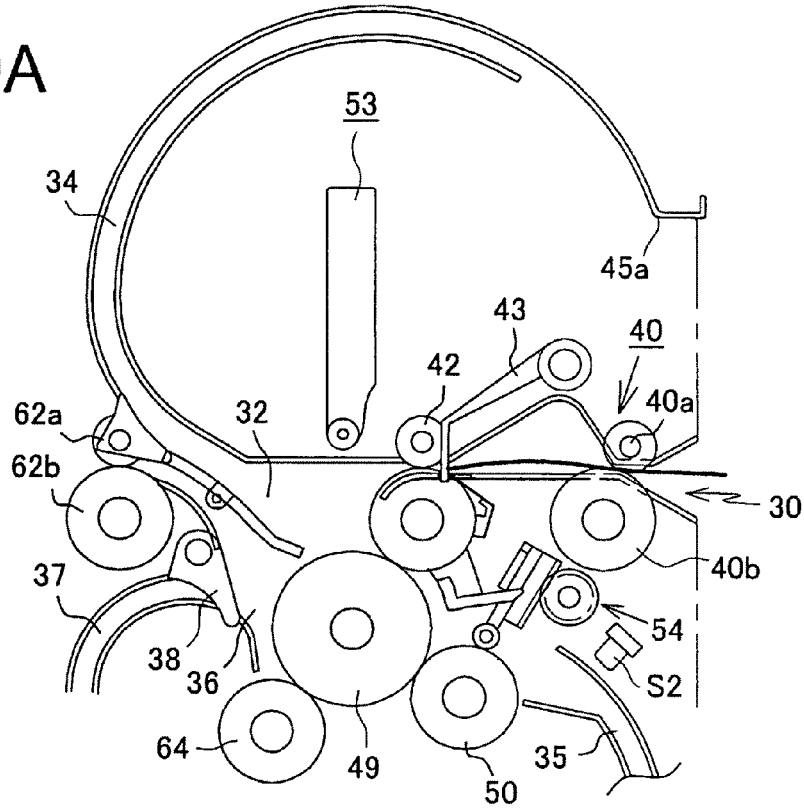
FIG. 19A and FIG. 19B contain explanatory views of an operating state of the apparatus of FIG. 3, where
Figure 19B:
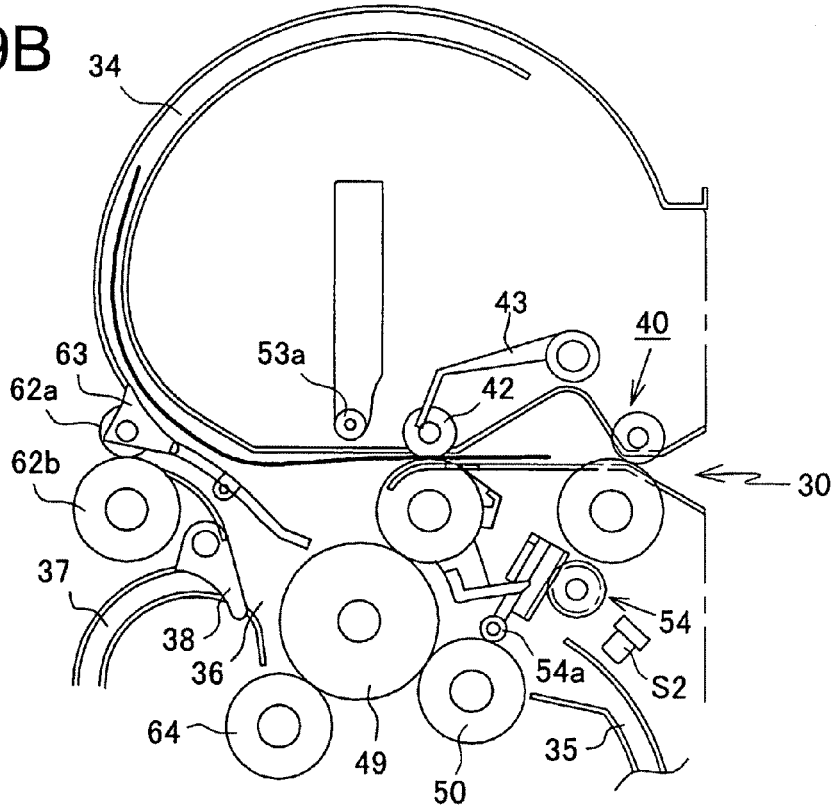
Figure 20A:
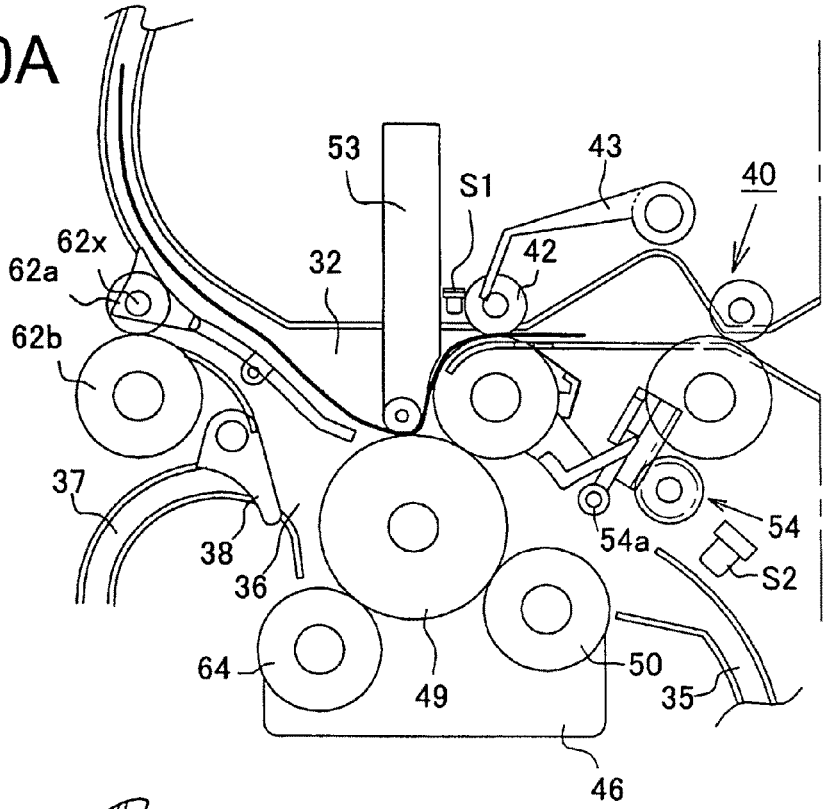
FIG. 20A and FIG. 20B contain explanatory views of the operating state of the apparatus of FIG. 3, where
Figure 20B:
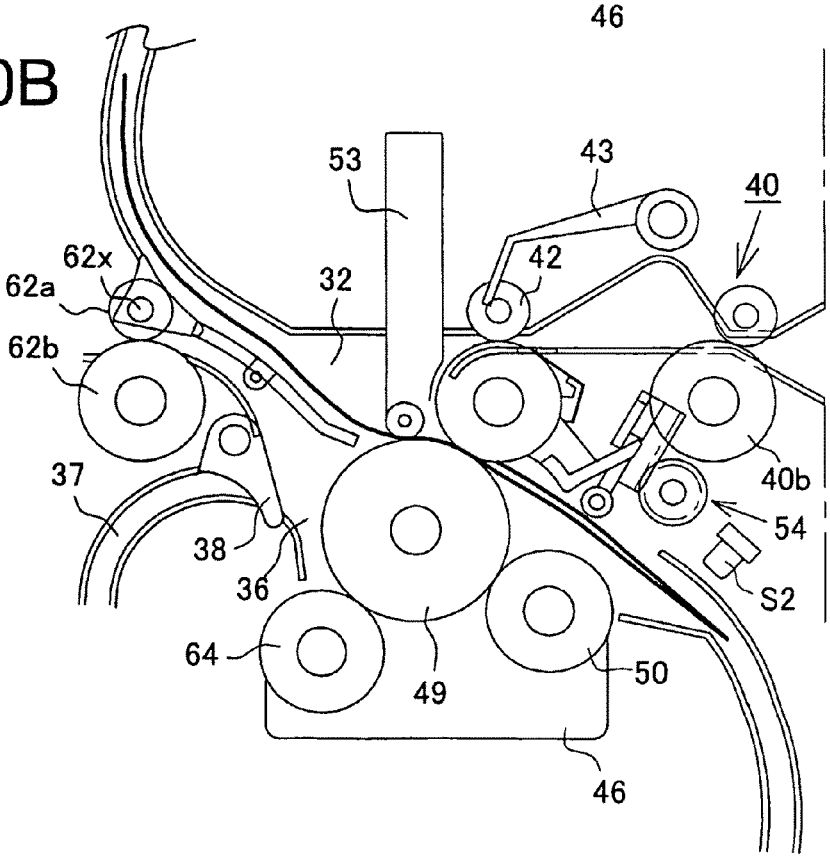
Figure 21A:
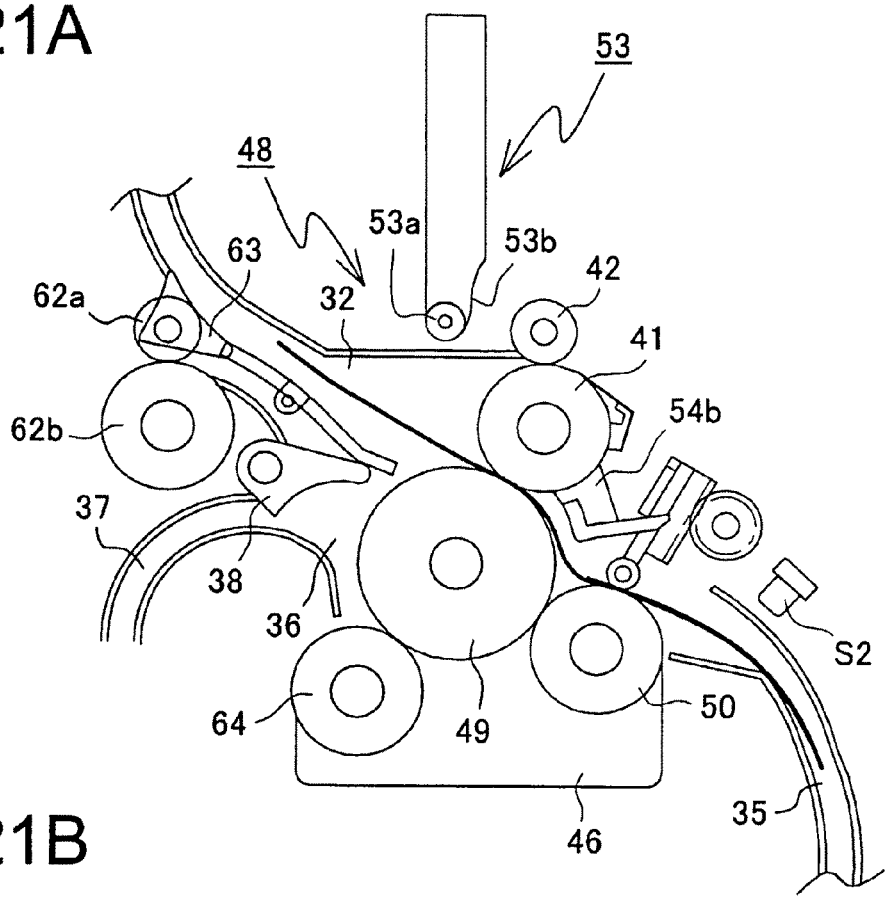
FIG. 21A and FIG. 21B contain explanatory views of the operating state of the apparatus of FIG. 3, where
Figure 21B:
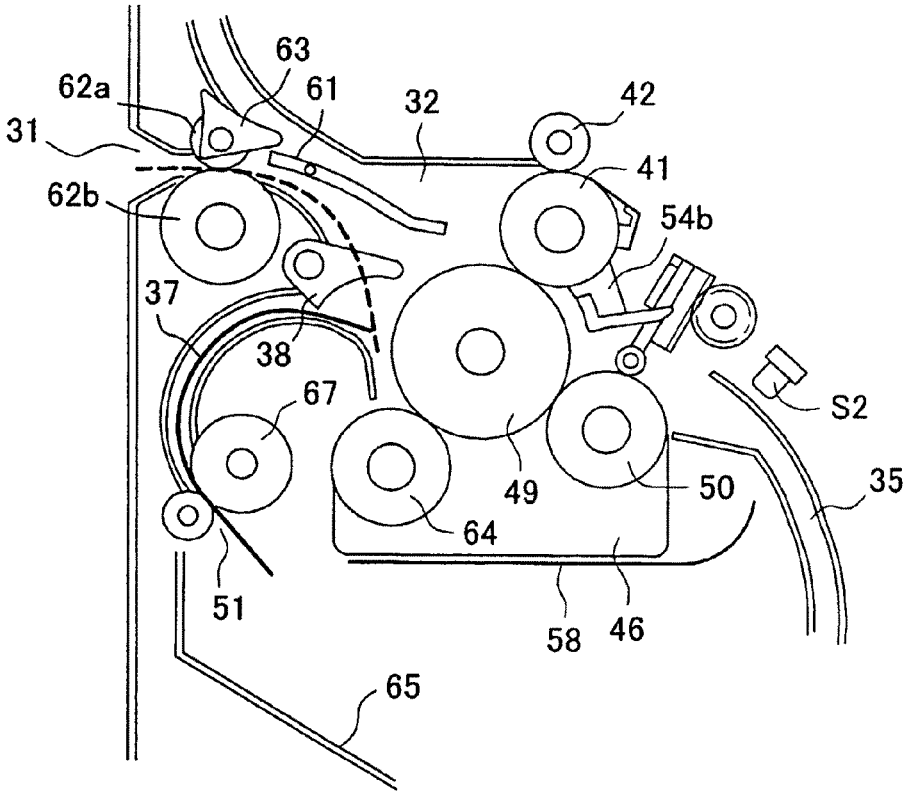

The action in the configuration of the sheet folding apparatus B will be described. FIG. 19A shows a state in which a sheet entering the carry-in entrance 30 undergoes register correction, and FIG. 19B shows a state in which the sheet is carried in the first switchback path 34 for first folding. FIG. 20A shows a state in which the sheet is folded in the first folding position Np1, FIG. 20B shows a state in which the folded sheet is carried in the second switchback path 35, FIG. 21A shows a state in which the sheet is folded in the second folding position Np2, and FIG. 21B shows is a state in which the folded sheet is carried out.

In FIG. 19A, a sheet is guided to the carry-in entrance 30, and fed to the downstream side by the carry-in roller pair 40. Then, the sheet front end is locked by the gate stopper 43, and the sheet is curved and deformed in the shape of a loop inside the register area, and is aligned in the front end.

In FIG. 19B, when the gate stopper 43 withdraws from first transport path 32, the sheet is fed to the downstream side in the first transport path 32 by the above-mentioned sheet transport mechanism. Then, the control means 95 controls the path switching means 63 so as to guide the sheet to the first switchback path 34 from the first transport path 32 as shown in FIG. 19B.

Thus, the sheet is carried in the first switchback path 34 by the pinch roller 42 and the second roller 41. In addition, in the first transport path 32, the first sensor S1 is disposed on the downstream side of the pinch roller 42 and the second roller 42, and detects the sheet front end carried in the first switchback path 34.

In FIG. 20A, based on a signal such that the first sensor S1 detects the sheet front end, the control means 95 shifts the up-and-down member 53*c* of the first folding deflecting means 53 from the waiting position to the actuation position at timing at which the fold position of the sheet is shifted to a predetermined position. Thus, the sheet in the first transport path 32 is deformed in the shape of a V toward the first nip portion Np1. Then, when the driven roller 53*a* attached to the up-and-down member 53*c* comes into press-contact with the periphery of the first roller 49, the sheet front end side is fed in the opposite direction (rotation direction of the first roller).

Meanwhile, the sheet rear end side feeds the sheet toward the first nip portion Np1 by transport force of the pinch roller 42 and the second roller 41. At this point, the curved guide surface of the curved guide 53*b* regulates the sheet to follow the roller periphery of the second roller 41.

Accordingly, the sheet is fed toward the first folding position Np1 on the front end side by the driven roller 53*a* and on the rear end side by the pinch roller 42 and the second roller 41, and up-and-down timing of the up-and-down member 53*c* is to calculate the fold position. Therefore, the control means 95 beforehand sets the velocity for shifting the sheet by the pinch roller 42 and the second roller 41 and the timing (particularly, timing at which the driven roller 53*c* comes into contact with the periphery of the first roller 49) for shifting the driven roller 53*a* to the actuation position from the waiting position at optimal values by experiments.

Then, the curved guide surface of the curved guide 53*b* guides the sheet to follow the periphery of the opposed second roller 41 in synchronization with the shift of the driven roller 53*a* from the waiting position to the actuation position, and therefore, there is no fear that the fold position of the sheet changes every time.

In FIG. 20B, the sheet folded in the ½ position (two-folding), ⅓ position (three-folding) or ¼ position (three-folding) in the first nip portion Np1 is provided with the transport force by the first nip portion Np1 and fed to the downstream side. Then, the control means 95 positions the up-and-down member 54*c* of the second folding deflecting means 54 in the actuation position in the two-folding mode, or in the waiting position in the three-folding mode. FIG. 20B shows control of the three-folding mode. In two-folding, the up-and-down member 54*c* is positioned in the actuation position, and the folded sheet is guided to the second nip portion Np2 beginning with the front end, and is fed to the carrying-out exit 31 on the downstream side.

Then, in the three-folding mode, the control means 95 positions the up-and-down member 54*c* of the second folding deflecting means 54 in the waiting position as shown in FIG. 20B. Thus, the sheet fed from the first nip portion Np1 is fed to the second switchback path 35 beginning with the front end. Then, the second sensor S2 detects the sheet front end (fold position).

In FIG. 21A, with reference to a detection signal of the second sensor S2, in a stage in which the fold position for second folding arrives at a predetermined position, the control means 95 shifts the up-and-down member 54*c* of the second folding deflecting means 54 from the waiting position to the actuation position. Then, the sheet inside the second switchback path 35 is fed in the opposite direction in a stage in which the driven roller 54*c* comes into contact with the periphery of the third roller 50.

By this means, the sheet is guided to the second nip portion Np2 by the front end side sending the sheet by the driven roller 54*a* and the rear end side sending the sheet by the first nip portion Np1 in respective opposite directions. In addition, in this case, the shift timing of the up-and-down member 54*c* from the waiting position to the actuation position is the same as in the case of the first folding deflecting means 53 as described previously, and the action of the guide member 54*b* is also the same as in the case.

In FIG. 21B, in the folded sheet fed to the second folding position (second nip portion) Np2, the fold is reliably folded by the folding enhancement roller 64 coming into press-contact with the first roller 49, and the sheet is carried to the sheet discharge path 36. Then, the control means 95 feeds the folded sheet to the sheet discharge path 37 or feeds the sheet back to the first transport path 32 corresponding to the before-hand set sorting form. In the apparatus as shown in the figure, in inward three-folding and outward three-folding of the letter folding form with no need of binding in the post-processing apparatus C, the control means 95 controls a path switching flapper 38 to guide the sheet from the sheet discharge path 37 to the storage stacker 65.

Further, in the two-folding mode and three-folding mode of ¼ Z-folding or the like for filing or with the need of the post-processing such as bookbinding processing, the sheet is carried to the first transport path 32 from the sheet discharge path 36, and fed to the post-processing apparatus C from the carrying-out exit 31.

[Folding Operation in the Two-Folding Mode]

Figure 24:
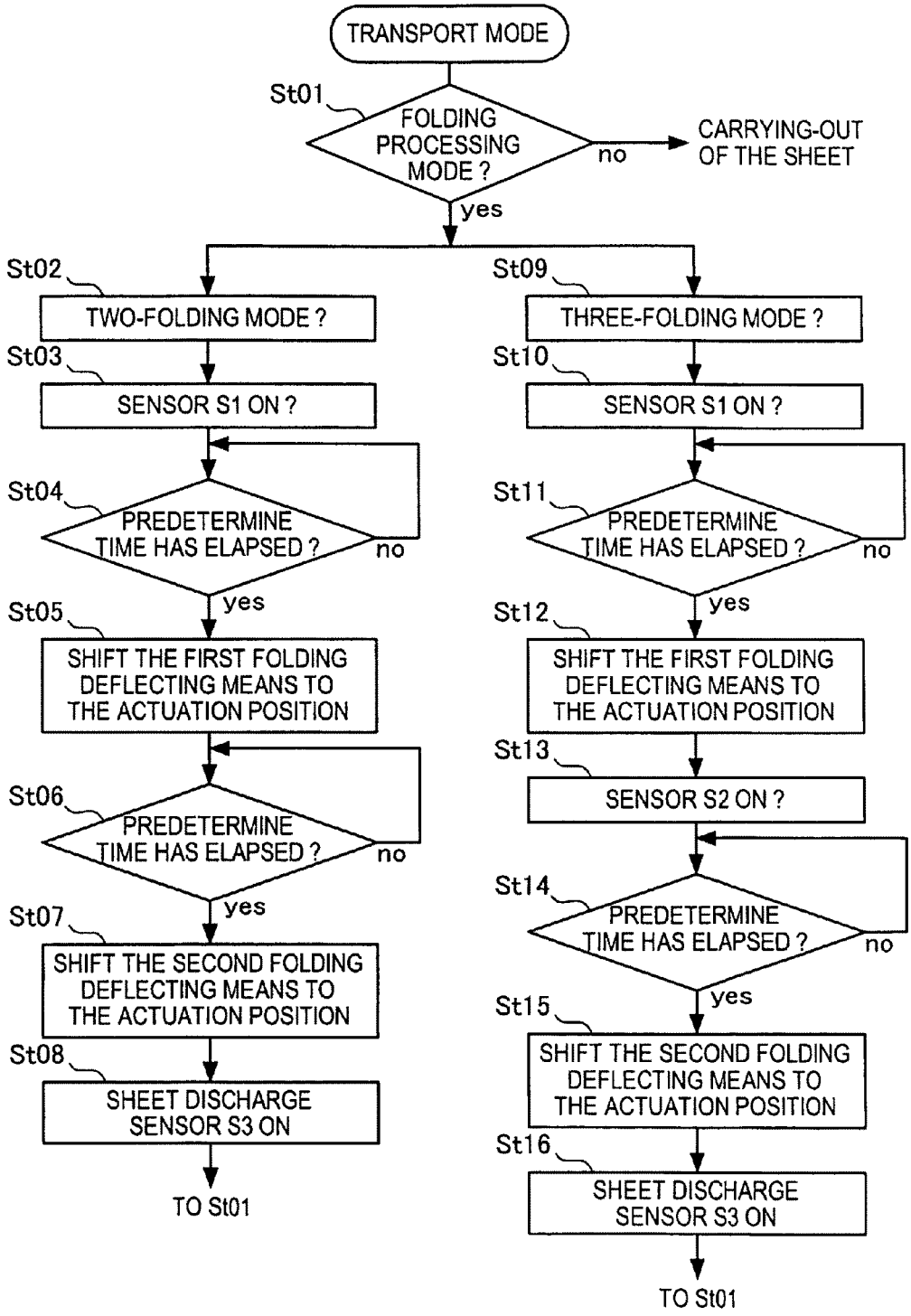
FIG. 24 is a flowchart illustrating processing operation in the control configuration of FIG. 23.

In the above-mentioned folding operation, in the mode for folding the sheet in two, as shown in FIG. 24, the control means 95 receives a mode instruction signal of whether or hot to perform folding processing concurrently with a sheet discharge instruction signal from the image formation apparatus A. Next, the control means 95 calculates the fold position in the fold position calculating means 97 (St01). Then, in the two-folding mode (St02), the first sensor S1 detects the sheet front end (St03). After a lapse of sheet feeding time corresponding to the sheet length calculated in the fold position calculating means 97 from the detection signal (St04), the control means 95 shifts the first folding deflecting means 53 from the waiting position to the actuation position (St05). This shift is controlled by rotation of the shift motor MS.

In the process during which the up-and-down member 53*c* of the first folding deflecting means 53 shifts to the actuation position, as described in FIG. 20A, the sheet in the first transport path 32 is distorted toward the first nip portion Np1 with reference to the fold position. Then, when the driven roller 53*a* of the first folding deflecting means 53 comes into contact with the periphery of the first roller 49, the sheet is drawn and inserted in the first nip portion Np1 beginning with the fold position.

At this point, in the two-folding mode, after a lapse of predicted time that the fold of the sheet is inserted in the first nip portion Np1 with reference to a detection signal from the first sensor S1 (St06), the control means 95 shifts the second folding deflecting means 54 to the actuation position (St07). The predicted time is set at time elapsed before the front end of the folded sheet arrives at the curved guide 54*b* after the fold position of the sheet is inserted in the first nip portion Np1. Accordingly, the front end of the folded sheet is guided by the curved guide surface of the curved guide 54*b* and is brought along the second roller periphery.

Concurrently therewith, since the driven roller 54*a* positioned in the actuation position rotates according to rotation of the third roller 50, even when the front end of the folded sheet is curled in the direction departing from the second nip portion Np2, the sheet is reliably guided to the second nip portion Np2 by the rotation of the driven roller 54*a* and third roller 50.

Then, the control means 95 carries the folded sheet, which is fed from the second nip portion Np2 to the sheet discharge path 36, to the first transport path 32 from the sheet discharge path 36. Next, the control means 95 prepares for processing of a subsequent sheet in a state in which the second folding deflecting means 54 is positioned in the actuation position (St08). In the apparatus as shown in the figure, in relation to the first folding deflecting means 53 positioned in the waiting position, the second folding deflecting means 54 shifting to positions in a relatively opposite manner is positioned in the actuation position, but it is also possible to configure so that the second folding deflecting means 54 shifts to the waiting position by a detection signal of a sheet discharge sensor S3 disposed in the sheet discharge path 36.

[Folding Operation in the Three-Folding Mode]

In the mode for folding the sheet in three, as described in FIGS. 19 to 21, the control means 95 receives a mode instruction signal of whether or not to perform folding processing concurrently with a sheet discharge instruction signal from the image formation apparatus A. Next, the control means 95 calculates the fold position in the fold position calculating means 97 (St01). Then, in the three-folding mode (St09), the first sensor S1 detects the sheet front end (St10).

After a lapse of sheet feeding time corresponding to the sheet length calculated in the fold position calculating means 97 from the detection signal (St11), the control means 95 shifts the first folding deflecting means 53 from the waiting position to the actuation position (St12). This shift is controlled by rotation of the shift motor MS.

In the process during which the up-and-down member 53*c* of the first folding deflecting means 53 shifts to the actuation position, as described in FIG. 20A, the sheet in the first transport path 32 is distorted toward the first nip portion Np1 with reference to the fold position. Then, when the driven roller 53*a* of the first folding deflecting means 53 comes into contact with the periphery of the first roller 49, the sheet is drawn and inserted in the first nip portion Np1 beginning with the fold position. At this point, in the three-folding mode, the control means 95 waits for the second sensor S2 to detect the sheet front end (St13).

After a lapse of predicted time that the second-folding fold position of the sheet arrives at a predetermined position with reference to a detection signal such that the second sensor S2 detects the sheet front end (St14), the control means 95 shifts the second folding deflecting means 54 to the actuation position (St15). The predicted time is set at a calculation value of the fold position calculating means 97. Then, the sheet is given the transport force from the driven roller 54*a* and is inserted in the second nip portion Np2. The sheet discharge sensor S3 detects the sheet front end, and the sheet is carried out to the first transport path 32 from the sheet discharge path 36, or carried out to the storage stacker 65 from the sheet discharge path 37 corresponding to the folding form (St16).

In addition, when the post-processing mode without performing the sheet folding processing is set from the mode setting means 92 in the above-mentioned step St01, the sheet is fed toward the carrying-out roller pair 62. Then, in the first transport path 32, the sheet guide 61 feeds the sheet front end into the nip portion of the carrying-out roller pair 62. Accordingly, the sheet is guided to the carrying-out exit (carrying-out portion) 31 smoothly without undergoing stress of the gate stopper 43, pinch roller 42 and second roller 41.

[Configuration of the Sheet Discharge Path]

The folded sheet that is folded in two or three as described above is fed to the sheet discharge path 36 from the press-contact point of the first and third rollers 49, 50. Then, the sheet is further folded by the folding enhancement roller (fourth roller) 64 in press-contact with the first roller 49, and guided to the sheet discharge path 36. The sheet discharge path 36 merges with the first transport path 32 as described previously. The sheet discharge path 37 branches off from the sheet discharge path 36, is provided via the path switching flapper 38, and guides the folded sheet to the storage stacker 65 disposed below the second transport path 33.

Accordingly, the sheet with no need of carrying to the post-processing apparatus C e.g. the sheet folded in the letter form such as inward three-folding and outward three-folding is stored in the storage stacker 65 without being carried to the carrying-out exit 31.

Then, in the folded sheet fed to the sheet discharge path 36, the sheet to feed to the post-processing apparatus C for post-processing is carried toward the carrying-out exit 31 by the carrying-out roller 62. In addition, in this case, the determination whether or not to perform post-processing is configured to be made by setting the post-processing condition concurrently with the image formation conditions in the control panel 15, for example. Then, it is configured that the sheet is carried out to the storage stacker 65 or carried to the post-processing apparatus C corresponding to the set finish condition.

[Image Formation Apparatus]

The image formation apparatus A is provided with the following configuration as shown in FIG. 1. In this apparatus, the paper feed section 3 feeds a sheet to the image formation section 7, the image formation section 7 prints in the sheet, and the sheet is carried out of the main-body sheet discharge outlet 18. The paper feed section 3 stores sheets of a plurality of sizes in paper cassettes 4*a*, 4*b*, and separates designated sheets on a sheet-by-sheet basis to feed to the image formation section 7. In the image formation section 7, for example, an electrostatic drum 8, and a printing head (laser emitting device) 9, developing device 10, transfer charger 11 and fuser 12 arranged around the drum 8 are disposed, the laser emitting device 9 forms an electrostatic latent image on the electrostatic drum 8, the developing device 10 adds toner to the image, the transfer charger 11 transfers the image onto the sheet, and the fuser 12 heats and fuses the image.

The sheet with the image thus formed is sequentially carried out of the main-body sheet discharge outlet 18. "13" shown in the figure denotes a circulating path, and is a path for two-side printing for reversing the side of the sheet printed on the front side from the fuser 12 via a main-body switchback path 14, then feeding the sheet to the image formation section 7 again, and printing on the backside of the sheet. Thus two-side printed sheet is carried out of the main-body sheet discharge outlet 18 after the side of the sheet is reversed by the main-body switchback path 14.

"20" shown in the figure denotes an image reading section, scans an original document sheet set on a platen 21 with a scan unit 22, and electrically reads the sheet with a photoelectric conversion element not shown. For example, the image data is subjected to digital processing in an image processing section, and then, transferred to a data storing section 16, and an image signal is sent to the laser emitting device 9. Further, "25" shown in the figure denotes a feeder apparatus, and feeds original document sheets stored in a stacker 24 to the platen 21.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from the control panel 15.

Meanwhile, the image formation apparatus A is configured so that image data read by the scan unit 22 or image data transferred from an external network is stored in the data storing section 16, the data storing section 16 transfers the image data to buffer memory 17, and that the buffer memory 17 transfers a data signal to the printing head 9 sequentially.

Concurrently with the image formation conditions, a post-processing condition is also input and designated from the control panel 15. As the post-processing condition, for example, selected is a "printout mode", "staple binding mode", "sheet-bunch folding mode" or the like. The post-processing condition is set for the folding form in the sheet folding apparatus B as described previously.

[Post-Processing Apparatus]

Figure 2:
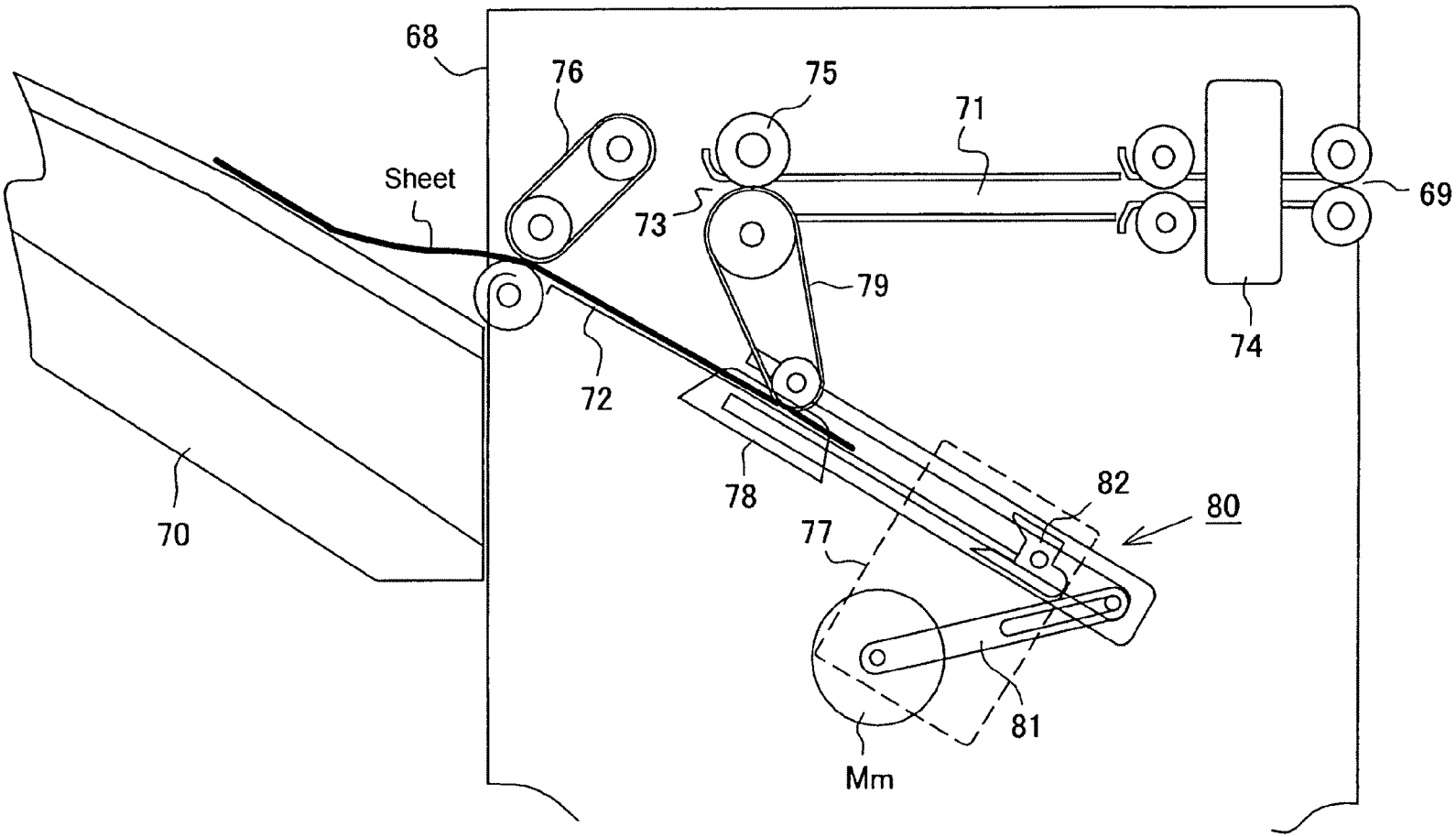
FIG. 2 is an enlarged explanatory view of principal part of a post-processing apparatus in the system of FIG. 1.

As shown in FIG. 2, the post-processing apparatus C is provided with the following configuration. This apparatus has a housing 68 provided with the sheet receiving opening 69, sheet discharge stacker 70, and post-processing path 71. The sheet receiving opening 69 is coupled to the carrying-out exit 31 of the sheet folding apparatus B as described previously, and is configured to receive a sheet from the first transport path 32 or the sheet discharge path 36.

The post-processing path 71 is configured to guide the sheet from the sheet receiving opening 69 to the sheet discharge stacker 70, and a processing tray 72 is provided in the path. "73" shown in the figure denotes a sheet discharge outlet, and is to collect sheets from the post-processing path 71 in the processing tray 72 disposed on the downstream side. "74" shown in the figure denotes a punch unit, and is disposed in the post-processing path 71. A sheet discharge roller 75 is disposed in the sheet discharge outlet 73 to collect a sheet from the sheet receiving opening 69 in the processing tray 72.

On the processing tray 72, sheets from the post-processing path 71 are switch-back transported (in the direction opposite to the transport direction), and collated and collected using a rear end regulating member (not shown) provided on the tray.

Therefore, above the tray is provided a forward/backward rotation roller 75 for switching back the sheet from the sheet discharge outlet 73. Further, the processing tray 72 continues to the sheet discharge stacker 70, and the sheet from the sheet discharge outlet 73 is supported (bridge-supported) on the front end side by the sheet discharge stacker 70 and on the rear end side by the processing tray 72.

On the processing tray 72 is disposed a stapler unit 77 for binding a sheet bunch positioned by the rear end regulating member. "78" shown in the figure denotes aligning means, and aligns the width of the sheet carried onto the processing tray in the direction orthogonal to the transport direction. "79" shown in the figure denotes a paddle rotating body, and is coupled to a rotary shaft of the sheet discharge roller 75 to be driven to carry the sheet from the sheet discharge roller 75 toward the rear end regulating member.

"80" shown in the figure denotes sheet bunch carrying-out means, and carries a sheet bunch bound by the stapler unit 77 to the sheet discharge stacker 70 on the downstream side. Therefore, the sheet bunch carrying-out means 80 shown in the figure is comprised of a lever member 81 axially supported at the base end portion to be swingable, and a sheet end engagement member 82.

Then, the sheet end engagement member 82 is equipped in the processing tray to reciprocate in the sheet discharge direction along the processing tray 72, and is coupled to the lever member 81. "Mm" shown in the figure denotes a driving motor for causing the lever member 81 to perform swinging motion. In addition, the sheet discharge stacker 70 is provided with an elevator mechanism, not shown, which moves up and down corresponding to a load amount of sheets.

In addition, this application claims priority from Japanese Patent Application No. 2010-123210 and Japanese Patent Application No. 2010-225836 incorporated herein by reference.

What is claimed is:

1. A sheet folding apparatus that is disposed between an image formation apparatus and a post-processing apparatus and that performs folding processing on a sheet with an image formed to carry to the post-processing apparatus, comprising:

a casing having a carry-in entrance to carry in a sheet from the image formation apparatus and a carrying-out exist to carry out the sheet to the post-processing apparatus;

a first transport path disposed inside the casing to carry the sheet from the carry-in entrance to the carrying-out exist without performing the folding processing;

a second transport path disposed in a direction crossing the first transport path to perform the folding processing on the sheet fed from the first transport path;

a folding roller pair disposed in the second transport path to perform the folding processing on the sheet; and sheet deflecting means for guiding a fold position of the sheet to the folding roller pair, wherein the casing is divided into an upper unit and a lower unit, the upper unit is provided with an upper sheet guide constituting the first transport path, and a sheet front end switchback path that constitutes part of the second transport path and that reveres the side of the sheet fed from the first transport path to carry toward the folding roller pair, the lower unit is provided with a lower sheet guide constituting the first transport path, the folding roller pair, and a sheet discharge path for guiding the sheet subjected to the sheet folding in the folding roller pair to the carrying-out exit, and the upper unit is coupled to the lower unit to be openable and closable by a hinge shaft rotating around one side end portion orthogonal to a sheet transport direction of the first transport path.

2. The sheet folding apparatus according to claim 1, wherein the hinge shaft has a shaft parallel to the sheet transport direction.

3. The sheet folding apparatus according to claim 1, wherein in the sheet transport path is disposed sheet transport means for carrying the sheet from the carry-in entrance toward the second transport path, the sheet transport means is comprised of a driving roller, and a pinch roller capable of coming into press-contact and separating with/from the driving roller, the pinch roller is provided with roller shift means that moves up and down between a press-contact position and a separation position with respect to the driving roller, the pinch roller and the roller shift means are provided in the upper unit, the driving roller is provided in the lower unit, and the roller shift means is coupled to a driving motor provided in the lower unit.

4. The sheet folding apparatus according to claim 3, wherein the pinch roller is comprised of a swing member having a swing spindle and a roller axially supported by the swing member, the roller shift means is comprised of a transmission gear for rotating the swing member, the transmission gear is coupled to a clutch gear disposed in the lower unit, the clutch gear is configured to be able to shift to a transmission state for conveying driving to the transmission state and a non-transmission state, and in the upper unit is disposed an interlock member for shifting the clutch gear from the transmission state to the non-transmission state in rotating around the hinge shaft.

5. The sheet folding apparatus according to claim 1, wherein in the first transport path is disposed a gate stopper for temporarily halting the sheet from the carry-in entrance to align a front end, the gate stopper is disposed in the upper unit to be able to move up and down between an actuation position facing the first transport path and a waiting position withdrawn outside the path, and gate shift means for moving the gate stopper up and down between the actuation position and the waiting position is coupled to the driving motor provided in the lower unit.

6. The sheet folding apparatus according to claim 5, wherein the gate stopper is comprised of a rotary spindle, and a gate hook that swings on the rotary spindle, the gate shift means is comprised of a cam follower formed integrally in the gate hook, and a rotary cam that engages in the cam follower, and the rotary cam has a cam surface that engages in the cam follower, and a guide surface for guiding the cam follower to the cam surface when the upper unit rotates around the hinge shaft.

7. The sheet folding apparatus according to claim 1, wherein in the first transport path are disposed sheet transport means for carrying the sheet from the carry-in entrance toward the second transport path, and a gate stopper for temporarily halting the sheet from the carry-in entrance to align a front end, the sheet transport means is comprised of a driving roller, a pinch roller capable of coming into press-contact and separating with/from the driving roller, and roller shift means for moving the pinch roller up and down between a press-contact position and a separation position, the gate stopper is comprised of a stopper hook capable of moving up and down between an actuation position facing the first transport path and a waiting position withdrawn outside the path, and gate shift means for moving the stopper hook up and down between the actuation position and the waiting position, and the roller shift means and the gate shift means are coupled to a driving motor provided in the lower unit, while shifting the pinch roller to the press-contact position and the gate stopper to the waiting position when the upper unit is opened to rotate around the hinge shaft.

8. The sheet folding apparatus according to claim 1, wherein in a cross portion of the first transport path and the second transport path is disposed path switching means for switching a transport direction of the sheet from the carry-in entrance, the path switching means is disposed in the upper unit to be swingable between a first guide attitude facing the first transport path and a second guide attitude shifted outside the path, path switching shift means for swinging the path switching means between the first guide attitude and the second guide attitude is comprised of a swing member provided integrally in a swing spindle and a lever member that engages in the swing member, and the lever member has an engagement surface that engages in the swing member, and a guide surface for guiding the swing member to the engagement surface when the upper unit rotates around the hinge shaft.

9. A sheet folding apparatus comprising:

a folding processing path for performing folding processing on a sheet fed from a carry-in entrance;

folding roller means forming a first folding press-contact portion, second folding press-contact portion and folding enhancement press-contact portion; and a sheet discharge path for guiding the sheet subjected to the folding processing in the folding roller means to a carrying-out portion, wherein the folding roller means is comprised of second, third and fourth rollers in press-contact in this order in a rotation direction of a first roller positioned in the center, and a guide member for guiding a folded sheet along the periphery of the first roller in between the third roller and the fourth roller, the first roller is provided in a first bracket member, while the first bracket member is supported by an apparatus frame to be swingable so that the first roller separates from the second roller and the third roller, the fourth roller and the guide member are provided in a second bracket member, while the second bracket member is supported by the apparatus frame to be swingable so that the fourth roller and the guide member separate from the first roller, and the first bracket member and the second bracket member are mutually interlocked to separate the first roller, the fourth roller and the guide member by operating means provided in one of the first member member and the second member member.

10. The sheet folding apparatus according to claim 9, wherein the second roller and the third roller are brought into press-contact with the periphery of the first roller at an angular interval within 180 degrees, and the first bracket member is supported by the apparatus frame to be swingable in the direction separating from the second roller and the third roller.

11. The sheet folding apparatus according to claim 9, wherein on the periphery of the first roller the second roller and the third roller are disposed to be brought into press contact at angular positions in the range of 0 degree to 180 degrees, while the fourth roller is disposed to be brought into press contact at an angular position in the range of 180 degrees and 360 degrees, using a vertical line passing through the circle center of the first roller as a base point, and the first bracket member swings to separate the first roller in conjunction with the second bracket member.

12. The sheet folding apparatus according to claim 9, wherein the second bracket member is axially supported by a rotary shaft of the third roller, and is supported to be swingable on the rotary shaft of the third roller.

13. The sheet folding apparatus according to claim 12, wherein the operating means is disposed in the second bracket member, and the second bracket member is provided with a cam engagement portion for shifting the first bracket member in a separation direction.

* * * * *